US006480695B2

(12) United States Patent
Endo et al.

(10) Patent No.: US 6,480,695 B2
(45) Date of Patent: Nov. 12, 2002

(54) CLEANING SYSTEM AND IMAGE FORMING METHOD

(75) Inventors: Isao Endo, Hachioji (JP); Hiroshi Morimoto, Hachioji (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 09/846,617

(22) Filed: May 1, 2001

(65) Prior Publication Data

US 2002/0009316 A1 Jan. 24, 2002

(30) Foreign Application Priority Data

| | | |
|---|---|---|
| May 10, 2000 | (JP) | 2000-137091 |
| May 10, 2000 | (JP) | 2000-137094 |
| Jun. 5, 2000 | (JP) | 2000-167440 |
| Jul. 12, 2000 | (JP) | 2000-211274 |
| Aug. 29, 2000 | (JP) | 2000-259080 |
| Dec. 12, 2000 | (JP) | 2000-377269 |

(51) Int. Cl.[7] ..... G03G 21/00

(52) U.S. Cl. ..... 399/349; 399/71; 399/350; 399/353; 399/354

(58) Field of Search ..... 399/343, 344, 399/349, 350, 351, 353, 354, 357, 71; 430/110, 111, 737; 15/256.5, 256.51

(56) References Cited

U.S. PATENT DOCUMENTS

| | | | | |
|---|---|---|---|---|
| 5,148,227 A | * | 9/1992 | Senba et al. | 399/349 |
| 5,701,559 A | * | 12/1997 | Ootaka et al. | 399/149 |
| 5,765,088 A | * | 6/1998 | Nakayama et al. | 399/350 |
| 5,937,228 A | * | 8/1999 | Shoji et al. | 399/55 |
| 5,970,302 A | * | 10/1999 | Yamane | 399/343 |
| 6,122,475 A | * | 9/2000 | Seto et al. | 399/308 |
| 6,130,018 A | * | 10/2000 | Kawata et al. | 430/111 X |
| 6,153,346 A | * | 11/2000 | Maehata et al. | 430/110 |
| 6,205,310 B1 | * | 3/2001 | Onishi | 399/176 |

FOREIGN PATENT DOCUMENTS

| | | |
|---|---|---|
| JP | 11295989 | * 10/1999 |

* cited by examiner

*Primary Examiner*—Hoan Tran
(74) *Attorney, Agent, or Firm*—Bierman, Muserlian, Lucas

(57) ABSTRACT

The present invention concerns a cleaning apparatus to clean an image bearing member used in electrophotographic process and an image forming system equipped with the cleaning system. The cleaning apparatus includes a cleaning roller being either conductive or semi-conductive and in contact with an image bearing member carrying charged toner; a constant current source to apply a bias voltage, having a polarity opposite to that of toner utilized for a developing operation performed on the image bearing member, onto the cleaning roller and a cleaning blade contacting the image bearing member and located at a downstream side of the cleaning roller in a moving direction of the image bearing member.

33 Claims, 17 Drawing Sheets

FIG. 9 ( a )
SCRAPER
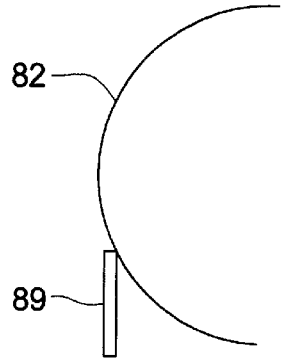
FIG. 9 ( b )
BRUSH
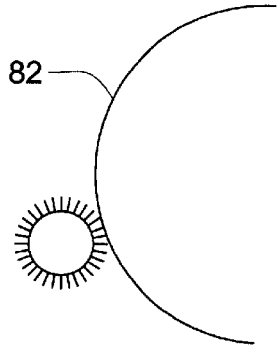
FIG. 9 ( c )
BIAS ROLLER
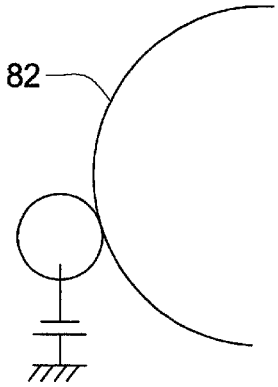

CLEANING SYSTEM AND IMAGE FORMING METHOD

BACKGROUND OF THE INVENTION

The present invention relates to a cleaning system to clean an image bearing member used in electrophotographic process and an image forming system equipped with said cleaning system.

In the field of image forming technology where images are formed by an electrophotographic system, efforts have been made in recent years to reduce toner particle size, thereby improving image quality. Resolution can be improved and sharp images can be formed by reducing toner particle size. However, the following problems arise in the cleaning process:

With the reduced size of toner particles, there is an apparent increase in adhesion of toner to the image bearing member. This makes it difficult to clean the image bearing member by removing it from the toner remaining after transfer. When using the cleaning method of using only the cleaning blade, cleaning failure occurs to deteriorate image quality. Especially when image is formed using the toner whose particles are formed by emulsion polymerization method or suspension polymerization method, cleaning failure called "sneaking-through" occurs, wherein remaining toner on the image bearing member passes through the cleaning system without being scraped off by the cleaning blade of the cleaning system. This is because the particle size is very small and toner particles are roughly spherical in shape.

Study is currently under way in an effort to solve the problem resulting from the reduced particle size of such toner particles. For example, Official Gazette of Japanese Patent Laid-Open NO.52808/1999 proposes the cleaning technology wherein conductive or semiconductive rubber is used as the material constituting the cleaning blade, and voltage having polarity reverse to that of toner is applied to the cleaning blade, thereby applying mechanical and electrical removing force to toner remaining on the image bearing member.

Official Gazette of Japanese Patent Laid-Open NO.189675/1991 discloses a cleaning technology which permits cleaning by installing a cleaning brush to apply electrostatic force and a cleaning blade to apply mechanical cleaning force on the downstream side of said cleaning brush.

In the image forming system based on electrophotographic method so far, a cleaning method using an elastic cleaning blade is known as a means of cleaning toner remaining on the image bearing member. This is extensively use for simple structure and lower cost.

In addition to cleaning of the toner after transfer, an image bearing member cleaning means is used to clean the surface of the image bearing member with a great deal of toner remaining thereon without being transferred, for example, after sudden suspension of the operation due to paper jamming or the like or on the patch created for image adjustment or the like.

When pulverized toner created by the conventional pulverization method is used, toner has been successfully scraped off for a long time without cleaning failure, even if a great deal of toner has reached the cleaning blade without being transferred.

In the image forming system based on electrophotographic method, many proposals have been put forth regarding the cleaning system laid out on the periphery of the carrier to clean the surface of the image bearing member.

In the normal image forming process, electrostatic latent image is formed on the image bearing member. After that, said electrostatic latent image is developed by toner to create a toner image. After said toner image is transferred, paper powder adhering to said carrier surface or remaining toner having failed to be transferred is removed by the cleaning system.

Amorphous toner produced according to the conventional pulverization method (average circularity of 0.95 or less) has been sufficiently scraped off only when the end of an elastic plate member called a cleaning blade is brought into mechanical contact with the surface of the image bearing member to scrape it off.

Said conventional cleaning technology, however, has the following problems:

(1) Sufficient cleaning cannot be performed when the potential distribution on the image bearing member is not uniform.

(2) If high voltage is applied to the cleaning blade for cleaning work, electric discharge or injection of electric charge into the image bearing member takes place. This results in image quality or image bearing member.

(3) Toner electrostatically attached to the cleaning blade is deposited with time, and deposited toner falls down to contaminate the image or interior of the equipment.

(4) If bias voltage applied to the cleaning roller in order to raise the cleaning performance of said cleaning roller, toner is absent between the downstream cleaning blade and image bearing member. This will deteriorate friction reducing effect by toner, and is likely to cause separation of the cleaning blade.

The cleaning system disclosed in said Official Gazette allows the cleaning function to be shared between a cleaning brush and cleaning blade, thereby ensuring improved cleaning performance. However, it has the following problems:

(5) Since the greater part of toner is removed by the brush located on the upstream side, the amount of toner between the toner carrier and cleaning blade can be very small. If this occurs, friction between the image bearing member and cleaning blade will be increased. This is likely to cause chattering where the cleaning blade vibrates, or curling where the cleaning blade tip rotates in the reverse direction following the image bearing member.

(6) According to an example disclosed in the Official Gazette of Japanese Patent Laid-Open NO.189675/1991, a high voltage is applied to the upstream brush roller and the image forming surface is likely to be damaged by electrical discharge. Especially in the initial phase of development, foreign substances (carrier in the developer, magnetic substance and mixed metal chip) are likely to deposit on an image former due to overshooting of the development bias. If a brush charged with said voltage is brought in contact with that portion, electric discharge will easily occur with the result that the image former is damaged and image failure occurs.

(7) In the real-world usage, toner deposits over the range in excess of the image forming area by scatters from the development device. When the disclosed art alone is used, it may be difficult to recover the toner having dispersed over said range. A simple countermeasure is to increase the width of the cleaning brush (roller). In this case, electric discharge occurs from the cleaning brush (roller) to which bias is applied to the substrate (aluminum used normally) of both image forming ends. This makes it difficult to maintain stable cleaning performances.

(8) In keeping with improvement of image quality in an image forming system, roughly spherical and small-sized toner is coming into use. Roughly spherical shape of toner is effective in increasing the development quality. Small-sized toner is essential to formation of a high resolution image. If the weight mean particle size is below 3 microns, however, deposition of toner on the image bearing member is caused by van der Waals force, with the result that fogging is produced to deteriorate image quality.

(9) Said roughly spherical and small-sized toner can be obtained with relative ease if it is made into polymerized toner (to be discussed later). Polymerized toner is preferably used to ensure high quality image. It is known in the related art that, when such polymerized toner is used, however, it is difficult to scrape said toner off the surface of the image bearing member with the cleaning blade as a cleaning means if much toner remains on the image bearing member.

(10) This is commonly explained by the following argument: The tip of said cleaning blade in contact with the image bearing member surface is vibrated by the rotation of the image bearing member, and a gap is produced between the tip of said cleaning blade and image bearing member surface due to said vibration. Since the polymerized toner is roughly spherical, it easily escapes through the above gap. This phenomenon tends to occur more frequently if the cleaning blade is used for a long time and friction of blade edge proceeds. Then cleaning failure is more likely to take place.

(11) For the reasons discussed above, there has been a problem of incomplete cleaning when a great deal of said toner without being transferred has arrived and the number of printings has increased.

(12) In response to the requirements for higher image quality in recent years, small sized roughly spherical polymerized toner with high mean circularity has come into use. Such polymerized toner with high mean circularity raises no problem when the cleaning blade has been replaced with a new one. In time it will gradually wears out resulting in poor contact with image bearing member. If contact pressure between cleaning blade and image bearing member is deteriorated, toner is considered to slip easily through the slight gap between the tip of the cleaning blade and the surface of the image bearing member, because of spherical shape of the toner particle. It can also be considered that both the shape and particle size are uniform and there is an increased affinity between toner particles with respect to the image bearing member.

(13) Toner with a high mean circularity is desired to be used to ensure high image quality. However, if cleaning of the image bearing member is not satisfactory, attached paper powder and remaining toner will adversely affect the formation of the next image, with the result that image quality is deteriorated.

SUMMARY OF THE INVENTION

The object of the present invention is to solve the problems in conventional cleaning technologies as indicated above.

Accordingly, to overcome the cited shortcomings, the object of the present invention can be attained by a cleaning apparatus described as follows.

1. A cleaning apparatus, comprising; a cleaning roller being either conductive or semi-conductive and in contact with an image bearing member carrying charged toner; a constant current source to apply a bias voltage, having a polarity opposite to that of toner utilized for a developing operation performed on the image bearing member, onto the cleaning roller; and a cleaning blade contacting the image bearing member and located at a downstream side of the cleaning roller in a moving direction of the image bearing member.
2. The cleaning apparatus of item 1, wherein the cleaning roller rotates in such a manner that its contact surface moves in the same direction as the moving direction of the image bearing member at a position in contact with the image bearing member, and the ratio between a roller moving velocity of the cleaning roller and a moving velocity of the image bearing member at the contact surface is within a range of 0.5:1 to 2:1.
3. The cleaning apparatus of item 1, further comprising: a removing member for removing toner from the cleaning roller by contacting the cleaning roller.
4. The cleaning apparatus of item 1, wherein the cleaning blade contacts the image bearing member with a pressing load being within a range of 1 to 30 grams/cm.
5. The cleaning apparatus of item 1, wherein the contact angle between the image bearing member and the cleaning blade is within a range of 0 to 40 deg.
6. The cleaning apparatus of item 1, wherein the hardness of the cleaning blade is within a range of 20 to 90 deg.
7. The cleaning apparatus of item 1, further comprising: a control section to control the constant current source so as to increase an absolute value of an electronic current applied by the constant current source according as an increase of an image-forming amount.
8. The cleaning apparatus of item 7, wherein the image-forming amount is a number of sheets on which images are formed.
9. The cleaning apparatus of item 1, further comprising: a control section to control the constant current source so as to increase an absolute value of a toner-collecting voltage applied by the constant current source according as an increase of an image-forming amount, wherein the toner-collecting voltage is equivalent to the bias voltage.
10. The cleaning apparatus of item 9, wherein the image-forming amount is a number of sheets on which images are formed.
11. The cleaning apparatus of item 1, further comprising: a control section to control the constant current source so as to apply either a toner-collecting voltage or a toner-releasing voltage onto the cleaning roller by selecting one of them in a time-sharing manner, wherein both the toner-collecting voltage and the toner-releasing voltage are equivalent to the bias voltage.
12. The cleaning apparatus of item 11, wherein the toner-releasing voltage is applied at every completion of forming images on a predetermined number of sheets.
13. The cleaning apparatus of item 12, wherein the predetermined number of sheets changes corresponding to a total number of sheets on which images are formed.
14. The cleaning apparatus of item 13, wherein the toner-releasing voltage is generated by superimposing an alternative current voltage on a direct current voltage.
15. The cleaning apparatus of item 1, further comprising: a control section to control the constant current source so as to increase an absolute value of a toner-collecting voltage according as an increase of an image-forming amount, and so as to apply either the toner-collecting voltage or a toner-releasing voltage onto the cleaning roller by selecting one of them in a time-sharing manner, wherein both the toner-collecting voltage and the toner-releasing voltage are equivalent to the bias voltage.

16. The cleaning apparatus of item 15, wherein the image-forming amount is a number of sheets on which images are formed.
17. The cleaning apparatus of item 15, wherein the toner-releasing voltage is applied at every completion of forming images on a predetermined number of sheets.
18. The cleaning apparatus of item 17, wherein the predetermined number of sheets changes corresponding to a total number of sheets on which images are formed.
19. The cleaning apparatus of item 17, wherein the toner-releasing voltage is generated by superimposing an alternative current voltage on a direct current voltage.
20. The cleaning apparatus of item 9, wherein the cleaning roller rotates in such a manner that its contact surface moves in the same direction as the moving direction of the image bearing member at a position in contact with the image bearing member, and the ratio between a roller moving velocity of the cleaning roller and a moving velocity of the image bearing member at the contact surface is within a range of 0.5:1 to 2:1.
21. The cleaning apparatus of item 9, further comprising: a removing member for removing toner from the cleaning roller by contacting the cleaning roller.
22. The cleaning apparatus of item 1, wherein an average circularity of toner particles included in the toner is within a range of 0.96 to 0.99, and a toner deposit amount per unit area on a surface of the image bearing member is not greater than 0.25 mg/cm$^2$ at a surface area ranging from a first position at which the image bearing member contacts the cleaning roller to a second position at which the image bearing member contacts the cleaning blade.
23. The cleaning apparatus of item 1, wherein an average circularity of toner particles included in the toner is not smaller than 0.96.
24. The cleaning apparatus of item 23, wherein the cleaning roller is an elastic roller.
25. A cleaning apparatus, comprising: a cleaning roller being either conductive or semi-conductive and in contact with an image bearing member carrying toner; an electric-power source to apply a toner-collecting voltage and a toner-releasing voltage onto the cleaning roller; a control section to control the electric-power source; and a cleaning blade contacting the image bearing member and located at a downstream side of the cleaning roller in a moving direction of the image bearing member, wherein the control section controls the electric-power source so as to apply either the toner-collecting voltage or a toner-releasing voltage onto the cleaning roller by selecting one of them in a time-sharing manner.
26. An image-forming apparatus, comprising: an image bearing member; a developing device; and the cleaning apparatus cited in item 1.
27. The image-forming apparatus of item 26, wherein the image bearing member is an organic photoreceptor.
28. The image-forming apparatus of item 26, wherein the developing device performs a developing operation by employing toner particles formed by a polymerization method, in which a volume average particle size of the toner particles is within a range of 3.0 to 8.5 microns.
29. The image-forming apparatus of item 26, wherein the cleaning apparatus comprises: a control section to control the constant current source so as to increase an absolute value of a toner-collecting voltage according as an increase of an image-forming amount, wherein the toner-collecting voltage is equivalent to the bias voltage.
30. The image-forming apparatus of item 26, wherein the cleaning apparatus comprises: a control section to control the constant current source so as to apply either the toner-collecting voltage or a toner-releasing voltage onto the cleaning roller by selecting one of them in a time-sharing manner, wherein both the toner-collecting voltage and the toner-releasing voltage are equivalent to the bias voltage.
31. The image-forming apparatus of item 29, wherein the control section controls the constant current source so as to apply either the toner-collecting voltage or a toner-releasing voltage onto the cleaning roller by selecting one of them in a time-sharing manner, wherein both the toner-collecting voltage and the toner-releasing voltage are equivalent to the bias voltage.
32. The image-forming apparatus of item 26, wherein the constant current source starts applying the bias voltage onto the cleaning roller after the image bearing member started moving and after a developing bias voltage has been applied onto the developing device, and further, the constant current source stops applying the bias voltage onto the cleaning roller before the image bearing member stops moving and before an operation of applying the developing bias voltage onto the developing device is finished.
33. The image-forming apparatus of item 26, wherein dimension W1 (mm), which indicates a width of the cleaning roller in its longitudinal direction, dimension W2 (mm), which indicates a width of a developer feeding device employed for the developing device in its longitudinal direction, and dimension W3 (mm), which indicates a width of the photosensitive layer on the image bearing member, fulfill a relational expression of $$W2<W1<W3.$$

34. The image-forming apparatus of item 26, wherein the constant current source applies the bias voltage onto the cleaning roller so that a toner deposit amount per unit area on a surface of the image bearing member is not greater than 0.25 mg/cm$^2$ at a surface area at which the image bearing member contacts the cleaning roller.
35. The image-forming apparatus of item 26, wherein an average circularity of toner particles included in the toner is within a range of 0.96 to 0.99, and a mass average particle size of the toner particles is within a range of 3 to 10 microns.
36. The image-forming apparatus of item 34, wherein a fur brushing roller is employed for the cleaning roller.
37. An image-forming apparatus, comprising: a first image bearing member: a plurality of developing devices arranged around a periphery of the first image bearing member; a second image bearing member on which a toner image formed on the first image bearing member is temporarily transferred; the cleaning apparatus cited in item 1, the cleaning apparatus being equipped for either the first image bearing member or the second image bearing member.

Further, to overcome the abovementioned problems, other cleaning systems, cleaning apparatus and cleaning methods, embodied in the present invention, will be described as follow:

a1. A cleaning system characterized by comprising: a conductive or semiconductive cleaning roller in contact with an image bearing member carrying the charged toner; a constant current source from which bias voltage having a polarity reverse to that of the toner related to development on said image bearing member is applied to said cleaning roller; and a cleaning blade contacting said image bearing member at the downward position in the movement of said image bearing member.

a2. A cleaning system according to item a1 characterized in that the contact surface of said cleaning roller rotates to move in the same direction as said image bearing member at the position in contact with said image bearing member, and the ratio between the traveling speed of the cleaning roller at the contact face and that of said image bearing member at the contact face and is in the range from 0.5:1 to 2:1.

a3. A cleaning system according to item a1 or a2 characterized by comprising a means of removing toner from said cleaning roller by contacting said cleaning roller.

a4. A cleaning system according to item a1 characterized in that said cleaning blade is brought in contact with said image bearing member at the load from 1 to 30 grams/cm.

a5. A cleaning system according to any one of items a1 to a4 characterized in that the contact angle between said image bearing member and said cleaning blade is within the range from 0 to 40 deg.

a6. A cleaning system according to any one of items a1 to a5 characterized in that the hardness of said cleaning blade is within the range from 20 to 90 deg.

a7. A cleaning system characterized by comprising: a conductive or semiconductive cleaning roller in contact with an image bearing member carrying the charged toner; a constant current source from which bias voltage having a polarity reverse to that of the toner related to development on said image bearing member is applied to said cleaning roller; a control means of controlling said constant current source; and a cleaning blade located at the downward position in the movement of said image bearing member, with said cleaning blade contacting said image bearing member; wherein said control means is characterized by controlling said constant current source so that said constant current source applies the current whose absolute value is changed according to the increase in the amount of the image formed.

a8. A cleaning system according to item a7 characterized in that the amount of the image formed is equivalent to the number of sheets for formed image.

a9. An image forming system comprising an image bearing member and a cleaning system according to any one of items a1 to a8.

a10. An image forming system according to item a9 characterized in that said image bearing member is an organic photoconductor.

a11. An image forming system according to item a9 or a10 characterized by comprising a development device wherein development is performed by using the toner whose particles are formed by polymerization method, with the volume mean particle size ranging from 3.0 to 8.5 microns.

b1. A cleaning system characterized by comprising: a conductive or semiconductive cleaning roller in contact with an image bearing member carrying the charged toner; a electronic-power source to apply toner-collecting voltage to said cleaning roller; a control means of controlling said electronic-power source; and a cleaning blade located downward of said cleaning roller in the direction of said image bearing member movement, with said cleaning blade contacting said image bearing member; wherein said control means is characterized by controlling said electronic-power source so that said toner-collecting voltage whose absolute value is changed according to the increase in the amount of the image formed is applied to said cleaning roller.

b2. A cleaning system according to item b1 characterized in that wherein the amount of the image formed is equivalent to the amount of the image formed.

b3. A cleaning system characterized by comprising: a conductive or semiconductive cleaning roller in contact with an image bearing member carrying the charged toner; a electronic-power source to apply toner-collecting voltage and toner-releasing voltage to said cleaning roller; a control means of controlling said electronic-power source; and a cleaning blade located downward of said cleaning roller in the direction of said image bearing member movement, with said cleaning blade contacting said image bearing member; wherein said control means is characterized by controlling said electronic-power source so that said toner-collecting voltage and said toner-releasing voltage are applied selectively in terms of time.

b4. A cleaning system according to item b3 further characterized in that said tone discharge voltage is applied at every formation of the image in specified numbers of sheets.

b5. A cleaning system according to item b4 further characterized in that said toner-releasing voltage is applied at every formation of the image in said specified of sheets which changes according to the number of sheets for formed image.

b6. A cleaning system according to any one of items b3 to b5 further characterized in that said toner-releasing voltage is composed of alternate current voltage (hereinafter, referred to as a.c. voltage) superimposed on direct current voltage (hereinafter, referred to as d.c. voltage).

b7. A cleaning system characterized by comprising: a conductive or semiconductive cleaning roller in contact with an image bearing member carrying the charged toner; a electronic-power source to apply toner-collecting voltage and toner-releasing voltage to said cleaning roller; a control means of controlling said electronic-power source; and a cleaning blade located downward of said cleaning roller in the direction of said image bearing member movement, with said cleaning blade contacting said image bearing member; wherein said control means is characterized by controlling said electronic-power source so that said recovery voltage whose absolute value is increased according to the amount of the image formed is applied, and said toner-collecting voltage and said toner-releasing voltage are applied selectively in terms of time.

b8. A cleaning system according to item b7 further characterized in that the amount of the image formed is equivalent to the number of sheets for formed image.

b9. A cleaning system according to item b7 or b8 further characterized in that said toner-releasing voltage is applied at every formation of the image in specified numbers of sheets.

b10. A cleaning system according to item b9 further characterized in that said toner-releasing voltage is applied at every formation of the image in said specified of sheets which changes according to the number of sheets for formed image.

b11. A cleaning system according to any one of items b7 to b10 further characterized in that said toner-releasing voltage is composed of a.c. voltage superimposed on d.c. voltage.

b12. A cleaning system according to any one of items b1 to b11 characterized in that the contact surface of said cleaning roller rotates to move in the same direction as said image bearing member at the position in contact with said image bearing member, and the ratio between the traveling speed of the cleaning roller at the contact face and that of said image bearing member at the contact face and is in the range from 0.5:1 to 2:1.

b13. A cleaning system according to any one of items b1 to b12 characterized by comprising a means of removing toner from said cleaning roller by contacting said cleaning roller.

b14. A cleaning system according to any one of items b1 to b13 characterized in that said cleaning blade is brought in contact with said image bearing member at the load from 1 to 30 grams/cm.

b15. A cleaning system according to any one of items b1 to b14 characterized in that the contact angle between said image bearing member and said cleaning blade is within the range from 0 to 40 deg.

b16. A cleaning system according to any one of items b1 to b15 characterized in that the hardness of said cleaning blade is within the range from 20 to 90 deg.

b17. An image forming system comprising an image bearing member and a cleaning system according to any one of items b1 to b16.

b18. An image forming system according to item b17 wherein said image bearing member is an organic photoconductor, said image forming system further characterized by comprising: a charging device to charge said organic photoconductor; an exposure device to expose said charged organic photoconductor; and a development device to form an image by developing the electrostatic latent image formed on said organic photoconductor by charging and exposure, and by depositing the charged toner thereon.

b19. An image forming system according to item b18 characterized in that development is performed by using the toner whose particles are formed by polymerization method, with the volume mean particle size ranging from 3.0 to 8.5 microns.

c1. An image forming system comprising: an image former having a photosensitive layer on the surface thereof, a development device by making latent image on said image former visible by means of toner; a transfer device to transfer a toner image on said image former to the transfer image bearing member; and a cleaning system to remove toner from the image former after transfer; said cleaning system further characterized by comprising at least; a cleaning roller which is located in contact with image former, rubs the image former surface and consists of a conductive or semiconductive elastic body; a cleaning blade consisting of an elastic body located downward of said cleaning roller in the direction of image former movement; and a electronic-power source to apply bias potential to said cleaning roller; wherein application of bias potential from said electronic-power source starts later than start of said image former movement or application of bias potential to said development device, and terminates later than termination of application of bias potential to said development device, and earlier than suspension of said image former movement.

c2. An image forming system according to item c1 characterized in that said electronic-power source is a constant current source.

c3. An image forming system according to item c1 or c2 characterized in that the toner making said latent image visible is synthesized by polymerization, and has a volume mean particle size ranging from 3.0 to 8.5 microns.

c4. An image forming system comprising: an image former having a photosensitive layer on the surface thereof; a development device by making latent image on said image former visible by means of toner; a transfer device to transfer a toner image on said image former to the transfer image bearing member; and a cleaning system to remove toner from the image former after transfer; said cleaning system further characterized by comprising at least; a cleaning roller which is located in contact with image former, rubs the image former surface and consists of a conductive or semiconductive elastic body; a cleaning blade consisting of an elastic body located downward of said cleaning roller in the direction of image former movement; and an electronic-power source to apply bias potential to said cleaning roller; said image forming system further characterized in that $$W2<W1<W3,$$

Where, W1: width of said cleaning roller in the longitudinal direction (mm), W2: width of developer feed in the longitudinal direction in said development device (mm), and W3: width of the photosensitive layer on said image developer in the longitudinal direction (mm).

c5. An image forming system according to item c4 characterized in that said electronic-power source is a constant current source.

c6. An image forming system according to item c4 or c5 characterized in that the toner making said latent image visible is synthesized by polymerization, and has a volume mean particle size ranging from 3.0 to 8.5 microns.

d1. An image forming method characterized in that; a mean circularity of the toner used for image formation is 0.96 to 0.99; a cleaning blade rubbing an image bearing member in contact therewith, and a toner recovery means installed on the upstream side of said cleaning blade are provided to remove the remaining toner deposited on the image bearing member after toner transfer; and cleaning is carried out when the deposit amount per unit area of toner on the image bearing member which reaches said cleaning blade after passing through said toner recovery means is smaller than 0.25 mg/cm$^2$.

d2. An image forming system wherein a toner image is formed on a rotating carrier, and toner remaining after having been transferred by a transfer means is cleaned by a cleaning system; said image forming system comprising a cleaning blade contacting and rubbing said image bearing member elastically and a toner recovery means located on the upstream side of said cleaning blade; said image forming system further characterized in that the bias voltage having a polarity reverse to the charging characteristics of toner is applied to said toner recovery means, and the deposit amount per unit area of passing toner is smaller than 0.25 mg/cm$^2$.

Said image forming system is preferred to use the toner having a mean circularity ranging from 0.96 to 0.99 and a weight mean particle size ranging from 3 to 10 microns. The present invention provides an image forming system which ensures formation of high quality image by excellent cleaning through the use of said toner.

e1. A cleaning system for cleaning an image bearing member to form images using toner with a high mean circularity of 0.96 or more, said cleaning system comprising: a cleaning blade for cleaning with its end in contact with said image bearing member; a cleaning roller located on the upstream side of said blade with said roller cleaning said image bearing member in contact with it; and a bias voltage application means for applying bias voltage to said cleaning roller.

e2. A cleaning system according to item e1 wherein said cleaning roller is a conductive elastic roller.

e3. A cleaning system according to item e1 or e2 comprising a control means for application of bias voltage by said bias voltage application means through d.c. constant current control.

e4. An image forming system comprising a cleaning system according to item e2 or e3.

e5. An image forming system comprising a cleaning system according to any one of items e1 to e3 characterized in that multiple development means are installed around the first image bearing member, a toner image formed on said first image bearing member is primarily transferred onto the second image bearing member, and the toner image on the secondary image bearing member having been primarily transferred in the above step is secondarily transferred onto a recording medium; wherein the cleaning system of said first image bearing member or said second image bearing member is the cleaning system according to any one of items e1 to e3.

e6. An image forming method comprising: a development process for forming images in the image bearing member using toner with a high mean circularity of 0.96 or more; a transfer step for transferring a toner image on said image bearing member; and a cleaning step for cleaning said image bearing member subsequent to said transfer step; said cleaning process further characterized in that the tip of the cleaning blade is brought in contact with said image bearing member to perform cleaning after a cleaning roller with bias voltage applied thereto is bought in contact with the image bearing member to perform cleaning.

e7. An image forming method according to item e6 characterized in that said cleaning roller is a conductive elastic roller.

e8. An image forming method according to item e6 or e7 characterized in that bias voltage is applied to said cleaning roller through d.c. constant current control.

BRIEF DESCRIPTION OF THE DRAWINGS

Other objects and advantages of the present invention will become apparent upon reading the following detailed description and upon reference to the drawings in which:

FIG. 9 is a drawing illustrating scraping of toner off the cleaning roller.

DETAILED DESCRIPTION OF THE PREFERRED EMBODIMENT

[Embodiment 1]

Figure 1:
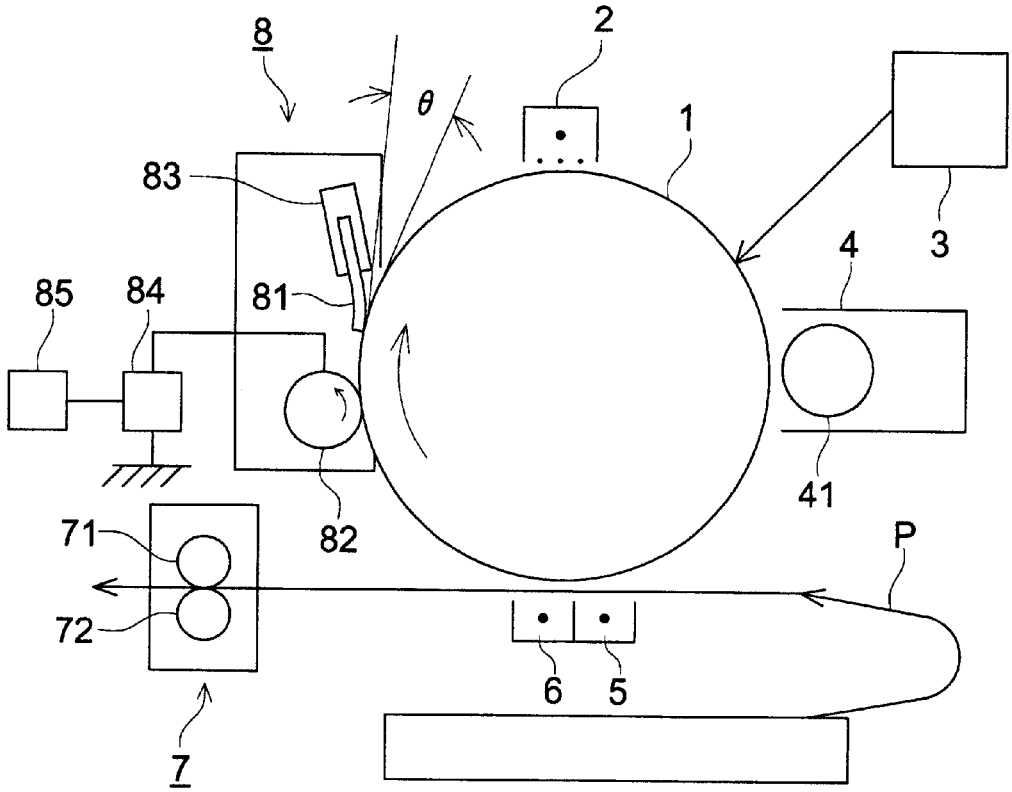
FIG. 1 is a drawing representing the image forming system as a first embodiment of the present invention.

FIG. 1 is a drawing representing an image forming system as an embodiment according to the present invention. In FIG. 1, numeral 1 denotes a photoconductor as an image bearing member.

From the view point of environmental conservation and cost reduction, said photoconductor is preferred to be an organic photoconductor with photosensitive layer consisting of resin with organic photoconductor dispersed thereon.

Numeral 2 denotes a charging device to charge said photoconductor 1 and to build up uniform potential on the photoconductor 1. This charging device is preferred to be a Scorotron charging device having a control grid and discharge electrode, or a charging device based on contact charging, using a roller with voltage applied thereto.

Numeral 3 indicates a exposure device for exposing the photoconductor 1 according to the image data. The exposure device is preferred to a scanning exposure device with a scanning optical system consisting of a polygon mirror, lens and mirror where a laser diode is used as a light source. Another preferred exposure device is a scanning optical device with light emitting diode array and imaging optical fiber. Said exposure device 3 provides dot exposure of the photosensor 1 according to the image data.

Numeral 4 indicates a development device. It stores one-component developer or two-component developer, and carries the developer to the area of developer by means of a development sleeve 41. It develop the electrostatic latent image on the photoconductor 1 to form a toner image on the photoconductor 1. The development sleeve is supplied with the d.c. development bias having the same polarity as the charging polarity of charging device 2 or development bias having the same polarity as the charging polarity of charging device 2 superimposed on the a.c. voltage. This is followed by the step of reversal development where toner is attached to the portion exposed by the exposure device 3.

Numeral 5 denotes a transfer device comprising a corona charging device. The transfer device 5 charges the recording paper P in the polarity reverse to that of toner on the photoconductor 1, and transfers the toner image to the recording paper P.

Numeral 6 denotes a separator comprising a corona charging device. It provides a.c. corona charging to recording paper P to eliminate electric charge from the recording paper P, and separate the paper from the photoconductor 1.

Numeral 7 denotes a fixing device. It fixes toner image on the recording paper P by means of a heating roller 71 with a built-in heating source (e.g. halogen lamp) and a heating roller 72 in contact therewith.

Numeral 8 indicates a cleaning system. Toner yet to be transferred or toner remaining after transfer is deposited on the photoconductor 1 after transfer. To start the next image formation step, the photoconductor 1 must be cleaned. Cleaning system 8 has a cleaning blade 81 consisting of elastic blade such as urethane rubber and a cleaning roller 82. The cleaning blade 81 is supported by a fixed blade holder 83, and the tip edge is kept in contact with with the photoconductor 1 at almost the constant pressure by the elastic property of the blade.

The blade holder 83 can be a blade holder which is rotatable about the shaft and which provides a certain contact pressure to cleaning blade 81 through the load of a spring or gravity.

The load of said cleaning blade 81 in the tip edge is preferred to be within the range from 1 g/cm to 30 g/cm, and is particularly preferred within the range from 5 g/cm to 25 g/cm.

If the load is smaller than 1 g/cm, cleaning force will be insufficient, and incomplete cleaning, hence, a contaminated image tends to result. If the load is greater than 30 g/cm, friction on the image bearing member surface will increase. When the image bearing member is used for a long time, the image tends to be scratchy or blurred. The load can be measured by applying the tip edge of the cleaning blade 81 in contact with the scale. Alternatively, it can be measured electrically by installing a sensor (e.g. a load cell) at the contact portion between the image bearing member and tip edge of the cleaning blade 8.

The contact angle of the cleaning blade 81 to the photoconductor 1 is preferred to be within the range from 0 to 40 degrees particularly within the range from 0 to 25 degrees. If this angle is greater than 40 deg., so called blade separation tends to occur; namely, the tip edge of the cleaning blade 81 tends to rotate in a reverse direction in conformity to the movement of the image bearing member. If this angle is smaller than 0 deg., cleaning force is reduced, with the result that image contamination tends to occur. The contact angle is an acute angle formed by intersection between the cleaning blade 81 and the contact surface of photoconductor 1 at the position where the tip edge of the cleaning blade 81 and photoconductor 1 are in contact with each other. As shown in FIG. 1, it is an angle θ as viewed on the downstream side in the rotational direction of photoconductor 1 from the cleaning position.

An elastic body such as urethane rubber is used as a cleaning blade 81. It is preferred to have a hardness (A, JIS) within the range from 20 to 90 as measured according to JIS K-6253.

If the angle is smaller than 20 deg., hardness is too small. This tends to cause blade separation. If it is 90 deg. or higher, the capacity will be too small to conform to slight irregularities of the image bearing member or foreign substances. This is likely to cause escape of toner particles.

The thickness of the cleaning blade 81 is preferred to be within the range from 1 mm to 3 mm, particularly within the range from 1.5 mm to 2.5 mm. The length of the portion not restricted by the blade holder 83, namely, the free length of the blade is preferred to be within the range from 2 mm to 20 mm, particularly within the range from 3 mm to 15 mm.

Numeral 82 denotes a conductive or semiconductive elastic cleaning roller.

Voltage having the polarity reverse to that of the toner used for development is applied to the cleaning roller 82 by means of the power supply 84. In other words, development is carried out by negatively charged toner. When a toner image is formed by the negatively charged toner, positive bias voltage is applied to the cleaning roller 82 from the power supply 84.

A constant current power supply (a constant current source) is referred to as power supply 84. When bias voltage is applied to the cleaning roller 82 from the constant current power supply, toner is electrostatically attracted to the cleaning roller 82 to provide an excellent cleaning effect. Current value applied from power supply 84 is changed under the control of a control means 85, as will be described later. What is called constant current power supply hereunder is a power supply designed to ensure that the output voltage is controlled in conformity to the resistance between the cleaning roller and image former so that a constant current is issued at all times.

The following describes the excellent cleaning effect in the present embodiment in comparison with the conventional method where constant voltage is applied.

An image portion, non-image portion and untransferred portion are present on the surface of the image bearing member after transfer. The surface potential varies according to the position. When constant voltage is applied to the cleaning roller, potential difference between the cleaning roller and image bearing member varies according to the potential distribution on the image bearing member, as described above. Different values are shown according to an image portion, non-image portion and untransferred portion.

Assume, for example, that V1 and V2 (where V1>V2) is present on the image bearing member. Where a constant potential V0 is applied to the cleaning roller, the potential difference between the surface of the image bearing member and cleaning roller will be V0−V1 and V0−V2, and electrostatic attraction acting on the charged toner on the image bearing member will become uneven, with the result that difference in cleaning effects appears depending on the site of the image bearing member. This leads to cleaning failure.

Compared to said constant voltage application, when the bias voltage of constant current is applied to the cleaning roller, electric field between the surfaces of the image bearing member and the cleaning roller affecting the force to separate the charged tone on the image bearing member from the image bearing member basically varies according to the impedance of the image bearing member viewed from the cleaning roller, independently of the potential on the image bearing member surface. The impedance of the image bearing member is basically constant independently of the position on the image bearing member.

Accordingly, uniform cleaning effect is obtained by application of constant current to the cleaning roller. Namely, independently of the surface potential of the image bearing member, roughly constant electrostatic attraction acts on the charged tone on the image bearing member. This allows uniform cleaning effect to be obtained without cleaning failure.

The applied current value is preferred to be within the range from 1 to 50 microamperes in terms of absolute value.

If the value is smaller than one microampere, a sufficient cleaning effect may not be obtained. If it is greater than 50 microamperes, electric discharge tends to occur. Said current value varies according to the type of the image bearing member and resistance of the cleaning roller. It is preferred to be within the range from 5 to 40 microamperes when using the organic photoconductor formed into a photosensitive layer having a thickness of 10 to 30 microns by dispersing in resin and a cleaning roller with a surface resistivity of $10^2\Omega/\square$ to $10^{10}\Omega/\square$.

A rubber elastic body is used as a cleaning roller. Such an elastic body is preferred to be made of rubbers such as silicone rubber and urethane rubber as is known in the art heretofore, foams or foams coated with resin film.

To get excellent performances, the hardness of the cleaning roller is desired to be within the range from 5 to 50 deg., or preferably from 10 to 50 deg. If it is below 5, durability will be insufficient. When it is greater than 60, the width of contact with image former required for cleaning cannot be obtained. Furthermore, damages may occur on the surface of the image former. Hardness is obtained by measuring the elastic body having been formed into a roller with an Ascar C hardness meter (load: 300 fg).

To ensure excellent performances, the width of the nip in constant with the image former is desired to be within the range from 0.2 to 5 mm or more preferably from 0.5 to 3 mm, although it varies with the roller diameter. If it is below 0.2 mm, cleaning capacity will be insufficient. If it is above 5 mm, the image former is likely to be damaged at the time of rubbing.

The cleaning roller is preferred to be conductive or semiconductive, and to have a surface resistivity within the range from $10^2\Omega/\square$ to $10^{10}\Omega/\square$. If the resistance is lower than $10^2\Omega/\square$, banding tends to occur due to electrical discharge. If it is greater than $10^{10}\Omega/\square$, the potential difference with the photoconductor will be reduced, and cleaning failure tends to occur.

The surface resistivity $\Omega/\square$ of the cleaning roller was measured at the normal temperature and relative humidity (26° C., 50% RH) at the applied voltage of 10 volts for the measuring time of 10 sec., using Hirester IP (MCP-HT250) and HA Probe by Mitsubishi Petrochemical Co., Ltd.

To ensure adequate resistance and nip width, the thickness of the conductive and semiconductive elastic layer is preferred to be set approximately in the range between 0.5 to 50 mm although it varies with the surface resistivity and hardness of the material.

The contact portion of the cleaning roller is desired to move in the same direction as the surface of the image bearing member. If said contact portion moves in the reverse direction, toner removed by the cleaning roller may spill and contaminate the recording paper or the system when excessive toner is present on the surface of the image bearing member.

When the image bearing member and cleaning roller move in the same direction as described above, the ratio of their surface speed is desired to be within the range from 0.5:1 to 2:1. Outside this range, the image bearing member may be damaged if the difference of their speeds increases, and recording paper or other foreign substance is sandwiched between the image bearing member and cleaning roller.

Figure 2:
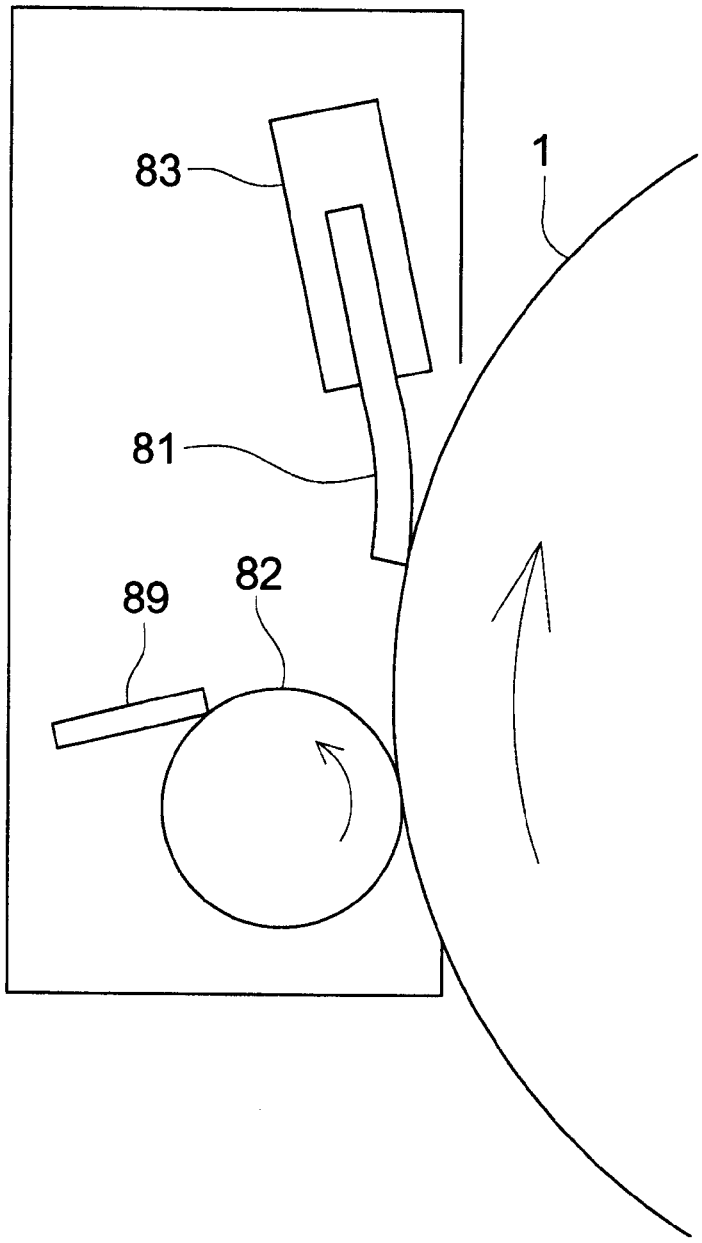
FIG. 2 is a drawing representing an example of the cleaning roller in the cleaning system according to the present invention.

Toner or other unwanted substance transferred from the image bearing member to the cleaning roller is desired to be removed by bringing the scraper in contact with the cleaning roller. FIG. 2 shows an example of installing a scraper 89 on the cleaning roller 82.

The scraper 89 uses such an elastic sheet as phosphor bronze sheet, polyethylene terephthalate sheet or polycarbonate sheet. It may contact the cleaning roller 82 in either the trail method where a tip forms an acute angle on the non-cleaning side of the cleaning roller 82 or the counter method where a tip forms an acute angle on the cleaning side of the cleaning roller 82.

To remove toner and other unwanted object transferred to the cleaning roller 82, a roller or brush may be used in addition to said scraper.

The cleaning system used in the image forming system related to the present embodiment is particularly effective when a photoconductor as an image bearing member as is described below and toner are used.

From the view point of environmental conservation and cost reduction, an organic photoconductor is considered as providing a good image bearing member. The organic photoconductor is represented by the photoconductor obtained by dispersing organic photoconductor in resin. This photoconductor consists of an organic compound provided with either electrical charge generation function or electrical charge feed function. The surface of the organic photoconductor has less strength, and cannot be subjected to powerful cleaning. If the contact pressure of the cleaning blade widely employed in the cleaning system is made too high, the surface of the organic photoconductor will be worn. To prevent this, the contact pressure is set at a lower value. This makes it difficult to ensure stable cleaning performance for a long time.

Use of said cleaning system ensures the good cleaning effect without having to increase the contact pressure of the cleaning blade. So even when the organic photoconductor is used as an image bearing member, said cleaning problems in the conventional systems have been solved.

In order to ensure high image quality, toner used in development is desired to have a volume mean particle size within the range from 3.0 to 8.5 microns, particularly from 3.0 to 6.5 microns. The volume mean particle size according to the present invention has been measured by Coulter Counter TA-II or Coulter Multitizer (by Coulter). In the present invention, the Coulter Multitizer was used wherein an interface (by Nikkaki) to output the particle size distribution was connected with a personal computer. A 100-micron aperture was used in said Coulter Multitizer. The volume average particle size was calculated by measuring the volume and quantity of the toner particles each having a diameter of 2 microns or more.

The toner having such a small particle size is particularly preferred to be the one where particles are formed by polymerization method including emulsion polymerization method, suspension polymerization method or dispersion polymerization method. Namely, the toner with its particles formed by polymerization method has a narrow distribution of particle size. Its form is not restricted to a spherical form; particles of a desired shape can be obtained. These advantages are effective in ensuring high image quality.

Toner whose particles are formed by polymerization includes the following two types. In one type, particles formed by polymerization are directly used as toner particles. In the other type, particles formed by polymerization are combined to form toner particles.

However, the toner of small particle size has a problem of difficult cleaning. Particularly the toner whose particles have been formed by this polymerization method has spherical toner particles in many cases. It has a conspicuous defect of difficult cleaning.

The embodiment of the present invention provides an excellent cleaning effect when images are formed using the toner of greater particle size produced by pulverization method where toner particles are formed by crushing the resin. Not only that, it provides an excellent cleaning effect for said toner of small particle size, particularly, the tone whose particles are produced by polymerization method.

In the cleaning work of removing toner from the image bearing member using the cleaning blade and cleaning roller to which bias voltage is applied, charged toner is electrostatically removed by the cleaning roller installed on the upstream side of the cleaning blade. Non-charged or reverse-charged toner or fine particles not removed by the cleaning roller are removed by the cleaning blade on the downstream side.

An effective way of improving cleaning performances is to increase the current value of the bias voltage applied to the cleaning roller. When the cleaning effect by cleaning roller is improved, however, such problems as separation of the cleaning blade and vibration of the tip of the cleaning blade tend to occur in the initial phase of image formation. This is considered to be due to the following reason: Toner working as a lubricant between the image bearing member and cleaning blade is removed by the cleaning roller; hence the amount of toner located at the tip of the cleaning blade is less than that in the conventional cleaning method depending on the cleaning blade alone. This phenomenon occurs particularly in the initial phase of image formation when the contact edge of the cleaning blade is sharp.

To solve such a problem in the present embodiment, a smaller current is applied to the cleaning roller in the initial phase of image formation, and, in response to increase in the amount of images to be formed, the current value is increased by a control means 85. This step ensures excellent cleaning effects throughout the entire image formation process in the present embodiment. The amount of images to be formed is preferred to be such that the time assigned for image formation and the number of sheets for formed image can be used.

In the initial phase of image formation when a new cleaning blade has been installed, the cleaning blade has excellent cleaning performances. Required cleaning performances can be obtained for an entire cleaning system without having to increase cleaning performances of the cleaning roller.

Figure 3:
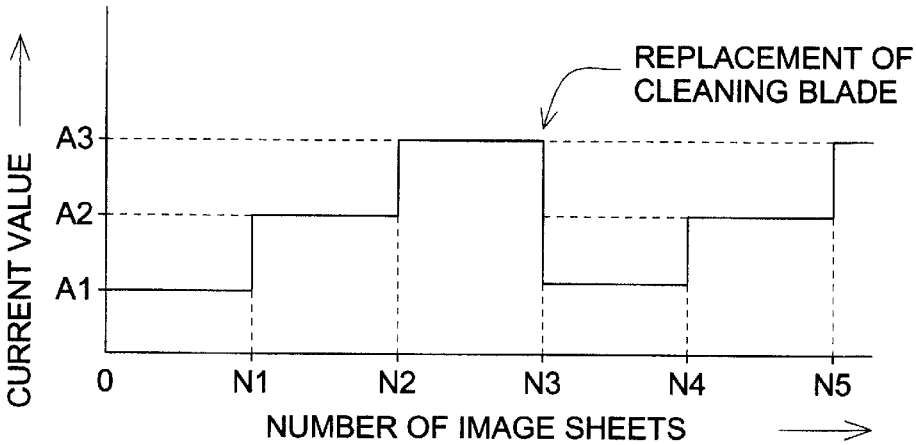
FIG. 3 is a chart representing the relation between bias voltage and the number of sheets for formed image.

FIG. 3 shows an example of the relation between the number of sheets for formed image and the current value of bias voltage applied to the cleaning roller. As shown, in response to the increase in the number of sheets for formed image from N1 to N3, current is increased stepwise from A1 to A3, for example. The current value is set back to the initial value at every replacement of the cleaning blade, and is increased in conformity to the number of sheets for formed image. This cycle is repeated.

The toner used in the present embodiment according to the present invention can be used for both one-component and two-component developers. Furthermore, it can be used as any one of magnetic toner and non-magnetic toner.

(1) In the present embodiment according to the present invention, an image formation test was conducted using the image forming system shown in FIGS. 1 and 3 under the following conditions with regard to the photoconductor as an image bearing member, exposure device, development device, toner, cleaning roller and cleaning blade:

EXAMPLE 1-1

Photoconductor:

A photoconductor consisting of a photoconductive layer with a thickness of 25 microns formed by said organic photoconductor dispersed in the polycarbonate resin being coated on the conductive drum made of aluminum (Al), using phthalocyanine pigment as an organic photoconductor Exposure device:

An exposure device to provide scanning exposure using a laser diode as a light source wherein a scanning optical system installed on said exposure device consists of a polygon mirror, lens and mirror.

Development device:

A development device, equipped with a development sleeve rotating at a linear velocity of 370 mm, to carry out reversal development using the two-component developer by applying bias voltage of the same polarity as that of the potential of the photoconductor to said development sleeve Toner:

Toner having a volume mean particle size of 6.5 microns the particles of which are formed by emulsion polymerization method Cleaning roller:

A conductive roller made up of foamed urethane having a surface resistivity of $5.0\times10^4\Omega/\square$. The hardness is 32 deg. Said roller is installed so that the nip portion in contact with image former is 2 mm wide. The roller is formed by winding an urethane layer on a 6 mm—diameter metallic shaft to a thickness of 4.5 mm. (roller: 15 mm in diameter)

To ensure movement in the same direction as the photoconductor at the position in contact with the photoconductor, drive and rotation were given by the drive system branched off from the photoconductor drive system. A scraper was provided to remove the toner from the roller surface. The traveling speed ratio between the image former and the contact portion was 1 to 1.

Current value of the bias voltage applied to the cleaning roller

+20 microamperes up to 150,000 sheets

Two cycles of this operation was performed to form up to 300,000 sheets of image. Constant current control power supply was used. Current flowing from the cleaning roller to the photoconductor was positive.

Cleaning blade:

The cleaning blade was made of urethane rubber. It had a hardness of 70 deg. with a thickness of 2.00 mm and a free length of 10 mm. The tip edge of this cleaning blade was brought in contact with the photoconductor at a contact angle of 10 deg. with a contact load of 5 g/cm.

Environment

Normal temperature and normal relative humidity (20° C., 50% RH) up to 50,000 sheets High temperature and high relative humidity (30° C., 80% RH) from 50,001 to 150,000 sheets.

The cleaning blades used has a durability to withstand 150,000 sheets.

In the experiment, cleaning blade was replaced when 150,000 sheets of image had been formed, and the succeeding 150,000 sheets were formed under said environment. Thus, a total of 300,000 sheets were formed.

EXAMPLE 1-2

Image formation was carried out under the same conditions as Example 1-1 except that the current value of bias voltage applied to the cleaning roller was changed as follows:

+5 microamperes up to 50,000 sheets

+15 microamperes from 50,001 to 100,000 sheets

+30 microamperes from 100,001 to 150,000 sheets (2) In a reference example, image formation test was conducted under the following conditions:

REFERENCE EXAMPLE 1

Same as EXAMPLE 1-1 except that no current is applied to the cleaning roller (0 microampere).

REFERENCE EXAMPLE 2

Same as EXAMPLE 1-1 except that a +500-volt constant voltage power supply was used as a power supply of voltage to be applied to the cleaning roller.

REFERENCE EXAMPLE 3

Same as Example 1-1 except that the traveling speed ratio on the contact surfaces between the cleaning roller and image former is 0.3 to 1.0.

REFERENCE EXAMPLE 4

Same as Example 1-1 except that the traveling speed ratio on the contact surfaces between the cleaning roller and image former is 2.5 to 1.

REFERENCE EXAMPLE 5

Same as Example 1-1 except that the contact load of the cleaning blade is 0.5 g/cm.

REFERENCE EXAMPLE 6

Same as Example 1-1 except that the contact load of the cleaning blade is 35 g/cm.

REFERENCE EXAMPLE 7

Same as Example 1-1 except that the hardness of the cleaning blade is 10 deg.

REFERENCE EXAMPLE 8

Same as Example 1-1 except that the hardness of the cleaning blade is 95 deg.

As a result of said experiment of image formation in Examples 1-1 and 1-2 according to the present invention, present inventors have obtained excellent images free from contamination or fogging. Especially in Example 1-2, stable cleaning performances without any blade vibration were obtained.

In Reference Example 1, images were contaminated by cleaning failure resulting from insufficient cleaning capacity of the cleaning blade after 40,000 sheets of image were formed.

In Reference Example 2, images were contaminated by local cleaning failure resulting from potential irregularity on the image former after 110,000 sheets of image were formed.

In Reference Example 3, scratches were produced on the image former due to rubbing, and black streaks appeared on the image after 60,000 sheets of image were formed.

In Reference Example 4, scratches were also produced on the image former due to rubbing, and black streaks appeared on the image after 60,000 sheets of image were formed.

In Reference Example 5, images were contaminated by cleaning failure resulting from insufficient cleaning capacity of the cleaning blade after 30,000 sheets of image were formed.

In Reference Example 6, local streaks were produced on the image former due to excessive wear of the image former film, fogging or scratching occurred on the image after 200,000 sheets of image were formed.

In Reference Example 7, the cleaning blade was curled up in the initial phase of image formation due to excessive faithfulness of the cleaning blade in following the movement on the image former.

In Reference Example 8, images were contaminated by cleaning failure resulting from poor response of the cleaning blade after 40,000 sheets of image were formed.

The above Embodiment 1 provides the following effects: Uniform excellent cleaning is ensured even if the image bearing member surface potential is not uniform. This makes it possible to configure a highly durable image forming system capable of providing formation of a sharp image free from contamination or fogging.

Sufficient cleaning performances are provided. Cleaning performances are excellent without damaging the image bearing member even if foreign substances are sandwiched between the image bearing member and cleaning roller.

Excellent cleaning performances are ensured for a long time.

It is possible to produce a highly durable image forming system characterized by excellent cleaning performances and prolonged service life of the image bearing member.

Excellent cleaning performances without curling of the blade can be ensured.

It is possible to prevent curling of the blade which often occurs if cleaning performance are improved. Excellent cleaning performances are ensured for a long time.

It is possible to configure a highly durable image forming system capable of providing formation of a sharp image free from contamination or fogging.

It is possible to produce an image forming system characterized by low cost and high image quality.

It is possible to provide an image forming system characterized by high image quality with respect to resolution and others.

[Embodiment 2]

The following describes the Embodiment 2 without duplicated explanation:

Voltage with polarity reverse to that of toner is applied to the cleaning roller 82 by the power supply 84. In the present embodiment according to the present invention, negatively charged photoconductor 1 is reversely developed by negatively charged toner to form an image. Said power supply 84 applies to the cleaning roller 82 the voltage with positive polarity reverse to that of the negatively charged toner (hereinafter referred to as "toner-collecting voltage"). Thus, the toner remaining on the photoconductor 1 after transfer is recovered and collected in the cleaning roller 82. The toner-collecting voltage is used to transfer toner on the photoconductor 1 to the cleaning roller 82 electrostatically. Its polarity is reverse to that of the toner having been involved in development to form images.

As will be described later, the power supply 84 applies toner-collecting voltage which is controlled by the control means 85 and is increased with the amount of image formed.

The following describes the cleaning action in the present embodiment according to the present invention: On the photoconductor 1, there is toner charged in reverse polarity and powder transferred from the recording paper P, in addition to the toner charged in the same polarity as charged potential of the photoconductor 1 in the development device 4. Particles of toner changed in the same polarity as that of the toner involved in the development device 4 in such a great variety of deposits are removed electrostatically by the cleaning roller 82. The non-charged toner, reversely charged toner and other particles which can not be removed by the cleaning roller 82 are removed mechanically by the cleaning blade 81.

Figure 4:
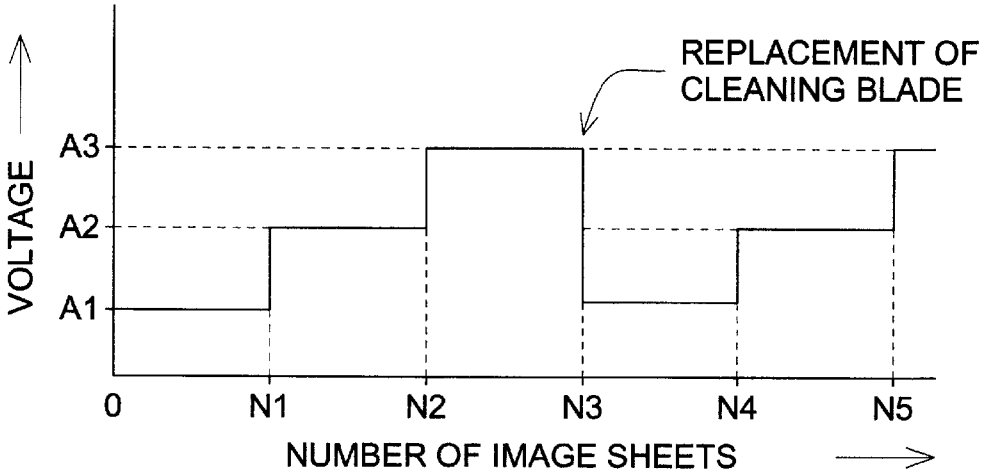
FIG. 4 is a chart representing the relation between toner-collecting voltage and the number of sheets for formed image.

In the present embodiment according to the present invention, the power supply 84 is controlled by the control means 85, as shown in FIGS. 1 and 4. As a result, voltage increasing with the amount of image formed is applied to the cleaning roller 82.

As the cleaning blade 81 is used, the cleaning performance thereof is gradually reduced due to the wear of the edge which scrapes off toner from the photoconductor 1. In the present embodiment according to the present invention, the cleaning performance of cleaning roller 82 is increased in response to the increasing amount of image formed, as shown in FIG. 2. Then the load applied to the cleaning blade 81 is reduced in response to the increasing amount of image formed. This ensures the cleaning performance of the entire cleaning system 8 to be maintained throughout the entire image formation process.

Toner is present between the photoconductor 1 and cleaning blade 81 and is known to work as lubricant. This function of toner allows smooth cleaning to be provided by cleaning blade 81. However, if there is little or no intervention of toner after it has been removed by the cleaning roller 82, a big frictional drag between the photoconductor 1 and cleaning blade 81 will occur. This will result in chattering where the cleaning blade vibrates or curling where the tip portion of the cleaning blade 81 is reversed in response to the photoconductor 1. If the cleaning performance by the cleaning roller 82 is excessive, the amount of said toner as lubricant will be reduced, with the result that chattering or curling tends to occur.

In the present embodiment according to the present invention, the voltage applied to the cleaning roller 82 is set at a relatively low value in the initial phase of image formation where the tip edge of the cleaning blade is sharp and curling tends to occur. Said voltage is increased in response to the increasing amount in image formation, thereby ensuring excellent cleaning performance throughout the entire image formation process.

The bias voltage is controlled as follows; When the number of sheets for formed image has increased from N1 to N3 as shown in FIG. 4, there is a gradual increase of bias voltage from V1 to V3, and the voltage is set back to the initial value V1 by exchange of the cleaning blade.

Toner-collecting voltage within the range from 0 or floating value to about one third of the maximum value V3 is preferred to be applied as initial value V1.

An elastic body is used as the cleaning roller 82. Rubber including well-known silicone rubber and urethane rubber, foam or foam coated with resin film is desired as a material of such an elastic body. The hardness of the cleaning roller within the range from 5 to 60 deg., preferably, 10 to 50 deg. is adequate to get the excellent performance. If the hardness is 5 deg., it is difficult to ensure high durability. If it is higher than 60 deg., it is difficult to secure the width of contact with the image former required for cleaning. In addition, damages tend to occur on the image former surface. The hardness is obtained by measuring the elastic body shaped into a roller with an Ascar C hardness meter (load: 300 fg).

To ensure excellent performances, the width of the nip when in contact with the image former is desired to be in the range from 0.2 mm to 5 mm, or preferably 0.5 mm to 3 mm, although this varies with the roller diameter. If the width is below 0.2 mm, cleaning force is insufficient. If it is over 5 mm, the image former tends to be damaged at the time of rubbing.

The cleaning roller 82 is conductive or semiconductive, and is desired to have the surface resistivity ranging from $10^2\Omega/\square$ to $10^{10}\Omega/\square$. If the resistivity is below $10^2\Omega/\square$, banding due to discharge tends to occur. Furthermore, it is higher than $10^{10}\Omega/\square$, potential difference is reduced, and cleaning failure tends to occur.

The surface resistivity $\Omega/\square$ of the cleaning roller was measured at the normal temperature and relative humidity (26° C., 50% RH) at the applied voltage of 10 volts for the measuring time of 10 sec., using Hirester IP (MCP-HT250) and HA Probe by Mitsubishi Petrochemical Co., Ltd.

To ensure adequate resistance and nip width, the thickness of the conductive and semiconductive elastic layer is preferred to be set approximately in the range between 0.5 to 50 mm although it varies with the surface resistivity and hardness of the material.

The cleaning roller 82 is desired to rotate so that the contact portion moves in the same direction as the surface of the photoconductor 1. If said contact portion moves in the reverse direction, the toner removed by the cleaning roller 82 may spill to contaminate the recording paper or the system, when excessive toner is present on the surface of the photoconductor 1.

When the photoconductor 1 and cleaning roller 82 move in the same direction as shown above, the surface speed ratio between the two is desired to be within the range from 0.5:1 to 2:1. Outside this range, the photoconductor may be damaged if the difference of their speeds increases, and recording paper or other foreign substance is sandwiched between the photoconductor 1 and cleaning roller 82.

It is desired to remove the toner and other foreign substances transferred from the photoconductor 1 to the cleaning roller 82 by bringing the scraper in contact with the cleaning roller 82. FIG. 2 shows an example of the scraper 89 installed on the cleaning roller 82.

The elastic plate such as phosphor bronze plate, polyethylene terephthalate plate or polycarbonate plate is used as the scraper 89. It may contact the cleaning roller 82 using either the trail system where the tip edge forms an acute angle on the uncleaned side of the cleaning roller 82 or the counter system where the tip forms an acute angle on on the cleaned side of the cleaning roller 82.

Furthermore, a roller and brush in addition to said scraper can be used to remove the toner and foreign substances transferred from the cleaning roller 82 to the cleaning roller 82.

The cleaning system used in the image forming system according to the present embodiment is especially effective when the image bearing member and toner to be described below is used.

From the view point of environmental conservation and cost reduction, organic photoconductor is useful as the image bearing member. The organic photoconductor is represented by the photoconductor produced by an organic photoconductor dispersed in resin, where the organic compound is provided with either electrical charge generation function or electrical charge feed function. The surface of the organic photoconductor has a low strength, which makes it difficult to use powerful cleaning capacity. If the contact pressure of the cleaning blade extensively used as a cleaning system is excessive, contact pressure is kept low by the wear of the organic photoconductor surface. This makes it difficult to ensure stable cleaning performance for a long time.

Use of said cleaning system allows the excellent cleaning effect to be obtained without having to increase the contact pressure of the cleaning blade. Even when the organic photoconductor is used as an image bearing member, it is possible to ensure stable excellent cleaning performance for a long time, and to solve said cleaning problem encountered in the conventional technology.

To ensure high image quality, the preferred toner used for development has a volume mean particle size ranging from 3.0 to 8.5 microns, more preferably from 3.0 to 6.5 microns.

The volume mean particle size of the toner according to the present invention is measured by the Coulter Counter TA-II or Coulter Multitizer (by Coulter). In the present invention, the Coulter Multitizer was used for measurement, and the interface (by Nikkaki) to output the data on particle size distribution was connected with a personal computer. A 100-micron aperture was used in said Coulter Multitizer to measure the volume and number of the tone particles of 2 microns or more, thereby calculating the volume mean particle size.

The toner having such a small particle size is particularly preferred to be the one where particles are formed by polymerization method including emulsion polymerization method, suspension polymerization method or dispersion polymerization method. Namely, the toner with its particles formed by polymerization method has a narrow distribution of particle size. Its form is not restricted to a spherical form; particles of a desired shape can be obtained. These advantages are effective in ensuring high image quality.

However, the toner of small particle size has a problem of difficult cleaning. Particularly the toner whose particles have been formed by this polymerization method has spherical toner particles in many cases. It has a conspicuous defect of difficult cleaning.

The embodiment of the present invention provides an excellent cleaning effect when images are formed using the toner of greater particle size produced by pulverization method where toner particles are formed by crushing the resin. Not only that, it provides an excellent cleaning effect for said toner of small particle size, particularly, the tone whose particles are produced by polymerization method.

(Toner whose particles are formed by polymerization includes the following two types. In one type, particles formed by polymerization are directly used as toner particles. In the other type, particles formed by polymerization are combined to form toner particles.

The toner used in the present embodiment according to the present invention can be used for both one-component and two-component developers. Furthermore, it can be used as any one of magnetic toner and non-magnetic toner.

[Embodiment 3]

The following describes the Embodiment 3 where excellent cleaning performances without chattering and curling of the cleaning blade can be ensured.

Figure 5:
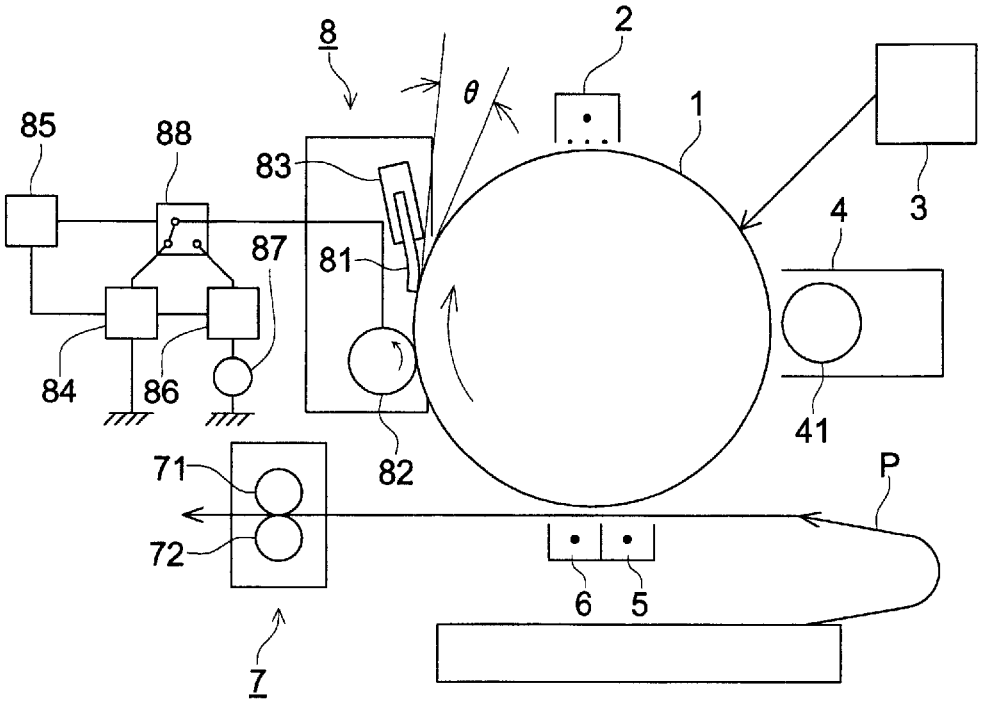
FIG. 5 is a drawing representing the image forming system as a second embodiment according to the present invention.

FIG. 5 shows the image forming system according to the Embodiment 3. In the Embodiment 3, power supplies 84 and 86 each having a reverse polarity with the other are connected to the cleaning roller 82 through temporal section. Namely, power supply 84 applies to the cleaning roller 82 the toner-collecting voltage which transfers the charged toner on the photoconductor electrostatically to the cleaning roller 82. The power supply 86 applies the voltage which transfers the charged toner on the cleaning roller 82 to the photocunductor 81. Namely, the power supply 86 applies the toner-releasing voltage. The polarity of the toner-releasing voltage is reverse to that of the toner-collecting voltage.

As described above, a proper amount of toner is present at all times on the photoconductor 1 by application of bias voltages reverse to each other and by discharging of the toner on the cleaning roller 82 onto the photoconductor 1. This avoids said chattering and curling.

Such a toner-releasing voltage is applied when cleaning by the cleaning roller 82 is not interfered. For example, it is preferred that toner-releasing voltage be applied at periodic intervals so that toner-releasing voltage is applied at every formation of 10 to 1000 sheets of image as to the number of sheets for formed image. Further, the periodic intervals of application of toner-releasing voltage can be changed in response to the volume of image to be formed. For example, excellent cleaning effect can be obtained by application of toner-releasing voltage at every formation of 1000 sheets of image in the initial phase, and at every formation of 500 sheets after formation of 100,000 sheets of image. As described in the embodiments described later, images can be formed while toner-releasing voltage is applied. It is also possible to apply toner-releasing voltage while rotating the photoconductor 1 without image formation, and to allow toner to be deposited on the photoconductor 1. Switching between toner-collecting voltage and toner-releasing voltage is performed by controlling the switch 88 using the control means 85.

In the image formation process based on reversal development, toner-releasing voltage is desired to be 1.2 times the white background potential. For example, when the white background voltage is −750 volts, voltage of −750 to −2250 volts is preferred. The voltage equivalent to 1/10 to 5 times the white background voltage is preferred in the image formation process based on normal development. When lower voltage, namely, reversal development is used to prevent discharge in the image formation system where discharge is likely to occur, 1 to 1.5 times the white background potential is preferred. When normal development is used, 1/3 to 2/3 times the black background potential is preferred in particular.

As toner-releasing voltage, it is also possible to apply the bias voltage obtained from a.c. voltage from the power supply 87 superimposed on the d.c. voltage from the power supply 86. Application of a.c. voltage provides an effective means for discharging toner from the cleaning roller 82 to the photoconductor 1. It is particularly desirable to use a.c. voltage within the frequency range from 0.5 kHz to 20 kHz. Further, as amplitude of the a.c. voltage, 1/3 to 2 times the white background potential is desirable in terms of peak-to-peak voltage in the image formation system based on reversal development. In the image formation system based on normal development, 1/3 to 2 times the black background potential is desirable.

A combined use of Embodiments 2 and 3 is also effective in improving the cleaning performances. Namely, the power supply 84 and switch 88 is controlled by the control means 85 in such a way that the toner-collecting voltage is increased in response to the increasing number of sheets for formed image, and toner-releasing voltage is applied to the cleaning roller 82 at periodic intervals, thereby ensuring an excellent cleaning effect. In such an embodiment, periodic intervals for application of toner-releasing voltage can be changed in response to the amount of formed image.

(1) Using the image forming system shown in FIGS. 1 and 2 as Examples 2-1 according to the present invention, image formation experiment was conducted with regards to the photoconductor as image bearing member, exposure device, development device, toner, cleaning roller and cleaning blade under the following conditions:

Photoconductor:

A photoconductor consisting of a photoconductive layer with a thickness of 25 microns formed by said organic photoconductor dispersed in the polycarbonate resin being coated on the conductive drum made of aluminum (Al), using phthalocyanine pigment as an organic photoconductor. Image formation is made by negative charging of the photoconductor.

The white background potential of −750 volts was used.

Exposure device:

An exposure device to provide scanning exposure using a laser diode as a light source wherein a scanning optical system installed on said exposure device consists of a polygon mirror, lens and mirror.

Development device:

A development device, equipped with a development sleeve rotating at a linear velocity of 370 mm, to carry out reversal development using the two-component developer by applying bias voltage of the same polarity as that of the potential of the photoconductor to said development during image formation sleeve Toner:

Negatively charged toner having a volume mean particle size of 6.5 microns the particles of which are formed by emulsion polymerization method Cleaning roller:

A conductive roller made up of foamed urethane having a surface resistivity of $4.5\times10^4\Omega/\square$ and a hardness of 30 deg. Said roller is installed so that the nip portion in contact with image former is 2 mm wide. The roller is formed by winding an urethane layer on a 6 mm-diameter metallic shaft to a thickness of 4.5 mm. (roller: 15 mm in diameter)

This roller was designed to turn in the same direction as the photoconductor (to move in the same direction at the nip portion). A scraper was provided to remove the toner from the roller surface. The peripheral speed ratio with the image former was 1 to 1.

Current value of the bias voltage applied to the cleaning roller

+100 volts up to 50,000 sheets
+300 volts from 50,001 to 100,000 sheets
+600 volts from 100,001 to 150,000 sheets Cleaning blade:

This cycle was repeated twice to form 300,000 images. The cleaning blade was made of urethane rubber. It had a hardness of 70 deg. with a thickness of 2.00 mm and a free length of 10 mm. The tip edge of this cleaning blade was brought in contact with the photoconductor at a contact angle of 10 deg. with a contact load of 5 g/cm.

Environment

Normal temperature and normal relative humidity (20° C., 50% RH) up to 50,000 sheets
High temperature and high relative humidity (30° C., 80% RH) from 50,001 to 150,000 sheets.

The cleaning blades used has a durability to withstand 150,000 sheets.

In the experiment, cleaning blade was replaced when 150,000 sheets of image had been formed, and the succeeding 150,000 sheets were formed under said environment. Thus, a total of 300,000 sheets were formed.

(2) In the Example 2-2, +600-volt toner-collecting voltage was applied to the cleaning roller throughout the entire image formation process, and 500-volt peak-to-peak voltage and 2 kHz-frequency a.c. voltage superimposed on −1000-volts d.c. voltage were applied as toner-releasing voltage in the following manner at periodic intervals:

Said toner-releasing voltage was applied in the formation of one sheet of image for every 1000 sheets in the range from 0 to 50,000 sheets, said toner-releasing voltage in the formation of one sheet of image for every 500 sheets in the range from 50,001 to 100,000 sheets, and said toner-releasing voltage in the formation of one sheet of image for every 100 sheets in the range from 100,001 to 150,000 sheets. Two cycles of said toner-releasing voltage application were repeated twice to form 300,000 sheets of image. In Example 2-3, the following toner voltages were applied:

+100 volts up to 50,000 sheets
+300 volts from 50,001 to 100,000 sheets
+600 volts from 100,001 to 150,000 sheets The same toner discharge electric field as in the case of Example 2-2 was applied at the same timing as the Example. A total of 300,000 sheets of image were formed by two cycles of said step. The test environment was the same as those in Examples 2-1 and 2-2; normal temperature and humidity (20° C., 50% RH) up to 50,000 sheets and high temperature and humidity (30° C., 80% RH) from 50,001 to 150,000 sheets. A total of 300,000 sheets of image were formed by two cycles of said step.

The test environment was the same as that in Example 1; normal temperature and humidity (20° C., 50% RH) up to 50,000 sheets and high temperature and humidity (30° C., 80% RH) from 50,001 to 150,000 sheets.

(3) In the Reference Example, image formation test was conducted under the following conditions.

REFERENCE EXAMPLE 1

Image formation was conducted under the same conditions as the Example except that +600-volt toner-collecting voltage was applied to the cleaning roller throughout the entire image formation process. In the Reference Example, toner-releasing voltage is not applied.

In Examples 2-1 and 2-2, stable excellent cleaning performances were ensured without image failure caused by curling and chattering of the cleaning blade or wear of the photoconductor, until formation of 300,000 sheets of image was completed.

In the Example 2-3, stable excellent cleaning performances were ensured without image failure caused by curling of the cleaning blade or wear of the photoconductor, particularly without any chattering of the blade under the conditions of high temperature and humidity, until formation of 300,000 sheets of image was completed.

In the Reference Example by contrast, curling of the cleaning blade occurred at the formation of 60,000th sheet after image formation started at a high temperature and humidity. Then the cleaning blade was replaced to continue image formation. Cleaning failure due to chattering occurred at a 240,000th sheet was formed. Stable cleaning performance could not be obtained.

The following effects are provided according to Embodiments 2 and 3:

Excellent cleaning effects are ensured for a long time without chattering or curling of the cleaning blade.

Chattering or curling of the cleaning blade was successfully avoided, and excellent cleaning effects were ensured for a long time.

Sufficient cleaning performances are provided. Cleaning performances are excellent without damaging the image bearing member even if foreign substances are sandwiched between the image bearing member and cleaning roller.

Excellent cleaning performances are ensured for a long time.

It is possible to produce a highly durable image forming system characterized by excellent cleaning performances and prolonged service life of the image bearing member.

Excellent cleaning performances without curling of the blade can be ensured.

It is possible to configure an image forming system capable of providing formation of high quality images free from contamination or fogging for a long time, without chattering or curling of the cleaning blade.

It is possible to produce an image forming system characterized by low cost and high image quality.

It is possible to produce an image forming system characterized by high image quality due to excellent resolution.

[Embodiment 4]

The following describes the Embodiment 4 without duplicated explanation:

Voltage having a polarity reverse to that of the toner is applied to the cleaning roller 82 by the power supply 84. Said power supply 84 applies to the cleaning roller 82 the voltage with positive polarity reverse to that of the negatively charged toner (hereinafter referred to as "toner-collecting voltage"). Thus, the toner remaining on the photoconductor 1 after transfer is recovered and collected in the cleaning roller 82. The toner-collecting voltage is used to transfer toner on the photoconductor 1 to the cleaning roller 82 electrostatically. Its polarity is reverse to that of the toner having been involved in development to form images.

As will be described later, the power supply 84 applies toner-collecting voltage which is controlled by the control means 85 and is increased with the amount of image formed.

The following describes the cleaning action in the present embodiment according to the present invention: On the photoconductor 1, there is toner charged in reverse polarity and powder transferred from the recording paper P, in addition to the toner charged in the same polarity as charged potential of the photoconductor 1 in the development device 4.

Particles of toner charged in the same polarity as that of the toner involved in the development device 4 in such a great variety of deposits are removed electrostatically by the cleaning roller 82. The non-charged toner, reversely charged toner and other particles which can not be removed by the cleaning roller 82 are removed mechanically by the cleaning blade 81.

The invention shown in Embodiment 4is intended to carry out electric cleaning (by a roller) to remove the greater part of the remaining toner. A means of mechanical cleaning (by a blade) is used to eliminate a very small amount of toner which cannot be removed electrostatically due to charging failure or charging in reverse polarity resulting from transfer.

Application of bias to the cleaning roller at this time is started later than start of image former traveling or application of bias to the development device. It terminates later than termination of application of bias to said development device and earlier than termination of said image former traveling.

If bias is applied when image formation stops, bias is applied to the same position of the image former for a long time. As a result, discharge tends to occur between that position and the roller, damaging both the image former and roller. Mechanical damage also tends to occur. To avoid overshooting of bias application, bias is preferred to be applied to the cleaning roller after start of image former movement or during its movement.

Figure 7:
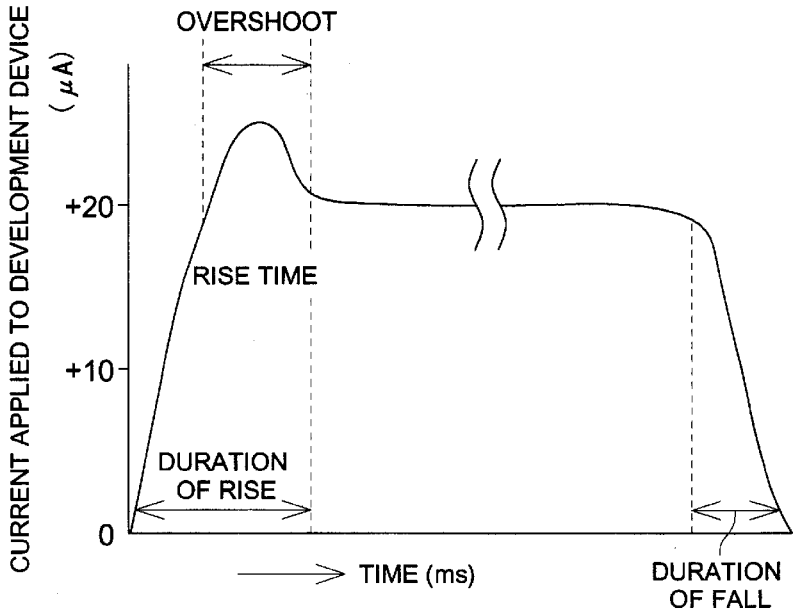
FIG. 7 is a drawing illustrating overshoot in development bias.

Further, the instant when bias is applied to the development device, the excessive voltage is applied to the development device due to overshoot as shown in FIG. 7. As a result, the carrier in the developer, magnetic substance or mixed metallic chip will be deposited on the image former to induce discharge from the cleaning roller. To avoid discharge to foreign substances by said overshoot width, it is preferred that the time of apply bias to the cleaning roller be delayed by application of bias to the development device, and bias be applied to the roller after the image former area to which foreign substances are deposited has passed through the roller section. Then foreign substances are mechanically scraped off by the downstream cleaning blade.

When application is stopped, the cleaning roller is located on the downstream side of the development device. Accordingly, in order to remove the developer on the image former between the development device and cleaning device from the time of stopping application of bias to the development device, it is basically necessary to stop application of bias to the cleaning roller after the lapse of time for the image former to travel between the development device and cleaning device.

From the viewpoint of preventing discharge, image former traveling is desired to be stopped after termination of the bias application, with consideration given to the falling time of bias applied to the cleaning roller.

Figure 8:
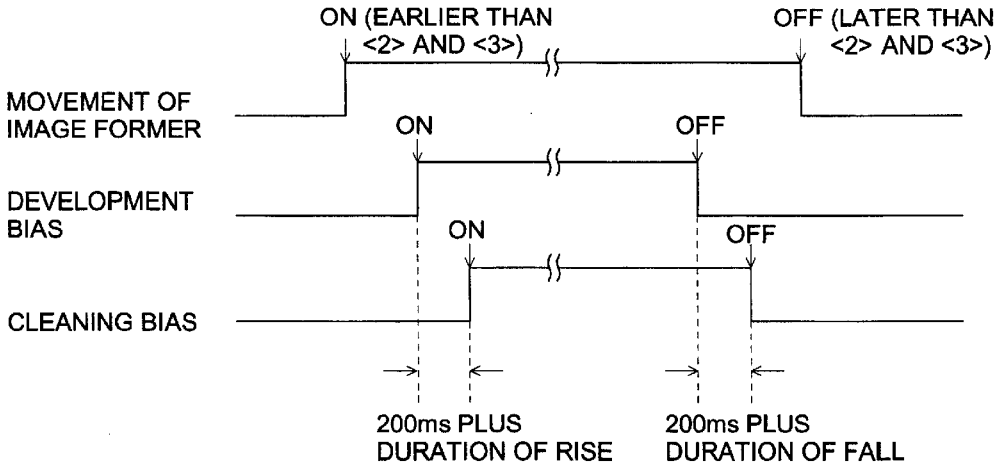
FIG. 8 is a drawing illustrating the time of starting or stopping application of bias to a cleaning roller.

The above can be summarized as follows:

As shown in FIG. 8, the timing for the start and stop of application of bias to the cleaning roller is given below:

Time of starting image formation: Start of image former traveling→Application of bias to development device→Application of bias to cleaning roller.

Time of stopping image formation: Start of application bias to development device→Start of application bias to cleaning roller→Stop of image former traveling.

The following describes the details of the components:

1-b) Cleaning blade

The actual blade load is 1 to 30 grams/cm, or preferably, 10 to 25 grams/cm. When it is below 1 grams/cm, cleaning force is insufficient, and a small amount of toner which cannot be removed by the roller may not be completely removed. When it is 30 grams/cm or more, the wear of the image former surface will increase, and fogging or blurring of image may occur after a long-term use.

For the measurement of loads, it is possible to use the numeral when the blade is pressed against a scale by the same amount as that of the setting condition, or the value obtained by electrical measurement by a sensor such as a load cell installed on the contact point with the image former.

The angle θ between the surface of said cleaning blade facing the image former, and the surface of said image former including said contact point between the cleaning blade and image former where said blade has passed is desired to be in the range from 0 to 40° C., more preferably from 0 to 25° C. When it is smaller than 0 deg., cleaning force is reduced. If it is greater than 40 deg., blade curling tends to occur, where the blade tip follows the travel of the image former and the blade is curled (See FIG. 1).

The blade can be supported by either stationary or rotary method if the angle between the load and blade is within the above range.

The rubber hardness of said cleaning blade is desired to be 20 to 90 deg., more particularly, 60 to 80 deg. If it is below 20 deg., the blade is too soft, and curling and cleaning failure tend to occur. If it is over 90 deg., the blade is too hard, and the blade cannot respond to a slight amount of foreign substances deposited on the image former. As a result, escape of toner particles tends to occur. The hardness of the blade is measured according to JIS K 6253.

Polyurethane and other materials known in the conventional technology can be used as a material for the blade. There is no resctriction if blade thickness, free length, load and angle are within said range. To ensure good load controllability and to avoid curling, the thickness is desired to be within the range from 1 to 3 mm, or preferably from 1.5 to 2.5 mm. The desirable free length is from 2 to 20 mm, or preferably from 3 mm to 15 mm.

1-c) Cleaning roller

To perform electric cleaning, bias is applied to the cleaning roller by power supply 84 (numeral 85 denotes its control means). Said power supply is preferred to be a constant current power supply. What is called constant current power supply hereunder is a power supply which is controlled to ensure that a constant current is issued at al times in the stable output range.

The polarity of the bias applied for cleaning is reverse to that of the tone used to create visible images. Namely, when toner is negatively charged, positive bias is applied to the cleaning roller. If bias is applied by the constant current power supply in this case, potential difference to feed a constant current at all times necessarily occurs to the roller surface and image former surface. This potential difference occurs constant at all times in response to the potential on the image former. Accordingly, compared to the case when the constant voltage power supply is used, irregularity due to the potential level of the image former and polarity or cleaning failure occur very infrequently.

As described above, application of bias to this cleaning roller starts later than the start of image former traveling or application of bias potential to said development device, and terminates later than termination of application of bias to said development device, and earlier than suspension of said image former movement.

For example, when the development device and cleaning roller section are 80 mm away from each other along the direction of image former traveling, and the traveling rate of this image former is 400 mm/sec and image formation (start of development on the image former to the latent image) is carried out 1000 ms after application of bias to the development device in an image forming system, application of bias to the cleaning roller can be started 200 to 1200 ms after application of bias to the development device.

More preferably, to avoid said overshooting of development bias in the initial phase, bias is preferred to be applied after the rising time of development bias power supply (200 ms in this case). A delay of approximately 10 to 200 ms (210 to 400 ms in this case) is preferred in this case although it varies with the power supply.

When application is stopped, the cleaning roller is located on the downstream side of the development device. Accordingly, in order to remove the developer on the image former between the development device and cleaning device from the time of stopping application of bias to the development device, it is basically necessary to stop application of bias to the cleaning roller after the lapse of time for the image former to travel between the development device and cleaning device (200 ms in this case).

In this case, consideration is given to the falling time of development bias power supply, and bias application to the cleaning roller is stopped after rising time (approximately 10 to 200 ms) added to the arrival time of the image former corresponding to stop of development bias (200 ms in this case). (210 to 400 ms later in this case) (See FIG. 8).

From the viewpoint of preventing discharge, image former traveling is desired to be stopped 10 to 1000 ms after termination of the bias application, with consideration given to the falling time of bias applied to the cleaning roller.

Based on the discussion given above, timing to apply bias to the cleaning roller is preferred to be determined in conformity to development bias timing in the case of an image forming system of other linear velocity.

A preferred current value to be applied is 1 to 50 microamperes in terms of absolute value. If it is below 1 microampere, cleaning will be insufficient. If it is over 50 microamperes, discharge will tend to occur. Although it varies with the thickness of the image former film and resistance of the cleaning roller, this value is 15 to 30 microns-equivalent to the film thickness of the organic photoconductor dispersed in isolating resin as an image former. When the roller surface resistivity of $10^2\Omega/\square$ to $10^{10}\Omega/\square$ is used, it is preferred to apply 5 to 40 microamperes in terms of absolute value.

The roller is made of an elastic body to ensure good contact with the image former. Such an elastic body can be made of rubbers such as silicone rubber and urethane rubber as is known in the art heretofore, foams or foams coated with resin film.

The surface resistivity of the roller is desired to be $10^2\Omega$ to $10^{10}\Omega/\square$, as described above. If the value is greater than $10^{10}\Omega/\square$, potential difference required to eliminate the toner cannot be obtained. If it is smaller than $10^2\Omega/\square$, discharge due to banding or others will tend to occur. The surface resistivity ($\Omega/\square$) of the cleaning roller was measured at the normal temperature and relative humidity (26° C., 50% RH) at the applied voltage of 10 volts for the measuring time of 10 sec., using Hirester IP (MCP-HT250) and HA Probe by Mitsubishi Petrochemical Co., Ltd. To ensure adequate resistance and nip width, the thickness of the conductive and semiconductive elastic layer is preferred to be set approximately in the range between 0.5 to 50 mm although it varies with the surface resistivity and hardness of the material.

To ensure excellent performances, the hardness of said cleaning roller is desired to be 5 to 60 deg., more particularly, 10 to 50 deg. If it is below 5 deg., durability will be poor. If it is over 60 deg., the width for contact with the image former required for cleaning will be difficult and the image former surface tends to be damaged. The hardness is obtained by measuring the elastic body shaped into a roller with an Ascar C hardness meter (load: 300 fg).

To ensure excellent performances, the width of the nip when in contact with the image former is desired to be in the range from 0.2 mm to 5 mm, or preferably 0.5 mm to 3 mm, although this varies with the roller diameter. If the width is below 0.2 mm, cleaning force is insufficient. If it is over 5 mm, the image former tends to be damaged at the time of rubbing.

To prevent toner from spilling, the contact portion of the cleaning roller is desired to move in the same direction as the image former. If it moves in the reverse direction, the recovered toner may spill on the transfer unit when excessive toner is present on the surface of the image bearing member (transfer failure or occurrence of jam).

The peripheral speed ratio with the image former and the roller (roller: image former) is desired to be within the range from 0.5:1 to 2:1. If it is below 0.5, cleaning capacity tends to reduce. If it is over 2, the image former tends to be damaged when foreign substances are sandwiched in-between.

The toner removed by the cleaning roller electrostatically is scraped off by a scraper 89 in contact with the roller. The scraper can be located in either the counter or trail direction with respect to the roller. A phosphor bronze plate, polyethylene terephthalate plate, polycarbonate plate or their combination known in the conventional technology can be used as the material for the scraper. This is not restricted to the scraper; a bias roller and fur brush can be used (see FIGS. 9(*a*), 9(*b*) and 9(*c*)). The toner collected by these cleaning system can be reused after being fed back to the development device.

1-d) Toner

To ensure high image quality and easy production, it is preferred to use the toner with a volume mean particle size of 8.5 microns or less, more preferably, 6.5 microns or less which has been manufactured by so called polymerization method wherein tone particles of a desired diameter can be obtained during the production of binding resin, without using the kneading and pulverizing process. Further, to ensure good toner charging stability at the time of development, use of toner with a particle size of 3 microns or more is desired.

Toner particles can be made by any one of emulsion polymerization method, suspension polymerization method or dispersion polymerization method known in the conventional technology. Even if toner particles are almost spherical, cleaning failure does not occur according to the present invention. If only the desired particle size is secured, there is no need of making toner particles indefinite.

The toner produced according to the conventional pulverization method can be used for the present invention. To make full use of excellent performance of the present invention, it is preferred to use the toner manufactured by the polymerization method.

The volume mean particle size of the toner according to the present invention is measured by the Coulter Counter TA-II or Coulter Multitizer (by Coulter). In the present invention, the Coulter Multitizer was used for measurement, and the interface (by Nikkaki) to output the data on particle size distribution was connected with a personal computer. A 100-micron aperture was used in said Coulter Multitizer to measure the volume and number of the tone particles of 2 microns or more, thereby calculating the volume mean particle size.

1-e) Others

If only the above configuration requirements are met in the present invention, there is no restriction in the development method. It is applicable to either one-component or two-component development, and either magnetic toner or non-magnetic development.

Figure 6:
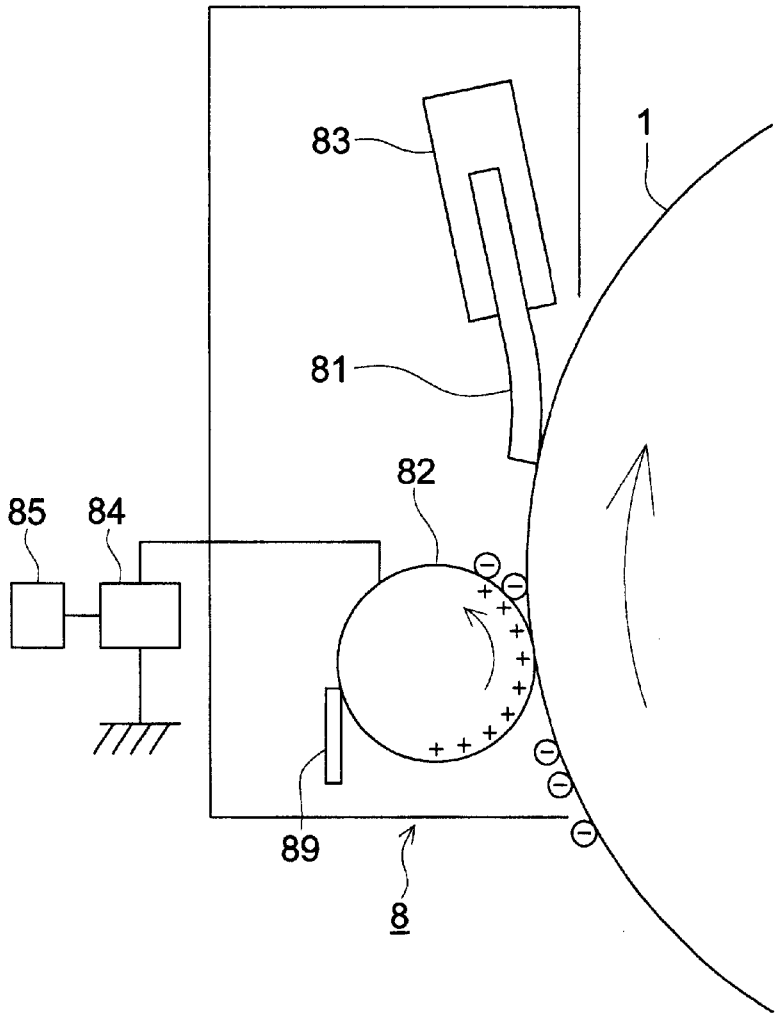
FIG. 6 is an enlarged view representing the configuration of a cleaning system.

2-a) Overall configuration (See FIGS. 1 and 6)

The invention shown in Embodiment 5 is the same as that of Embodiment 4 in that electric cleaning is carried out (by a roller) to remove the greater part of the remaining toner, and a means of mechanical cleaning (by a blade) is used to eliminate a very small amount of toner which cannot be removed electrostatically due to charging failure or charging in reverse polarity resulting from transfer.

Figure 10:
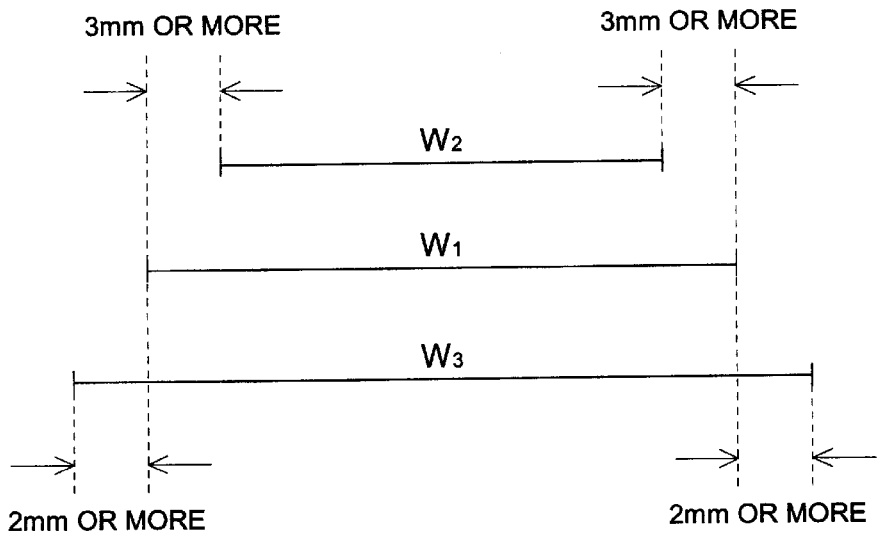
FIG. 10 is a drawing illustrating the adequate width along the length of a cleaning roller.

However, said invention shown in Embodiment 5 is further characterized by:

$W2<W1<W3$ (See FIG. 10)

where;

W1: width of said cleaning roller in the longitudinal direction (mm),

W2: width of developer feed in the longitudinal direction in said development device (mm), and W3: width of the photosensitive layer on said image developer in the longitudinal direction (mm).

If W1>W3, on the substrate of the image former electric discharge will occur from the cleaning roller with the result that the cleaning performance is seriously deteriorated. If W1<W2, toner will scatter from the development device, and toner deposited outside the range of the cleaning roller cannot be removed. Hence, W2<W1<W3 is preferred.

To recover the scattered toner, W1 is preferred to be at least 3 mm or preferably at least 7 mm greater than W2 on both sides (see FIG. 10). If there are much toner on the image former which cannot be recovered, the charged electrode and optical system will be contaminated, and such image failure as fogging or white streak will be observed.

To prevent electric discharge to conductive substrate of the image former, W1 is preferred to be at least 2 mm or preferably at least 6 mm smaller than W3 on both sides (see FIG. 10). If there is electric discharge to conductive substrate of the image former, current will flow in that portion and the potential difference required for cleaning does not occur on the cleaning surface. As a result, cleaning failure tends to be observed.

Figure 11:
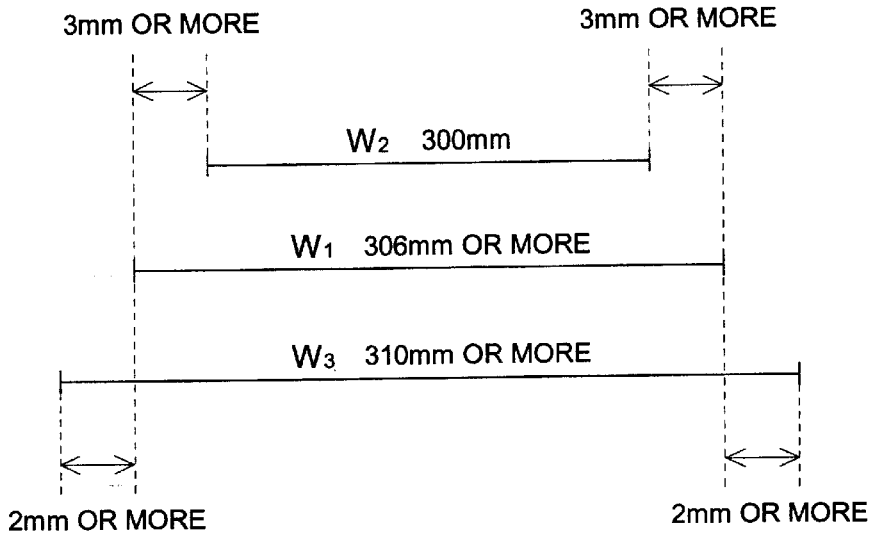
FIG. 11 is a drawing illustrating the adequate width along the length of a cleaning roller.

For example, if W2 is 300 mm, W1 is at least 306 mm, at least 3 mm greater than W2 on both sides. The width of photosensitive layer W3 is set to at least 310 mm, at least 2 mm greater than W1 on both sides. (See FIG. 11).

The width of the cleaning blade is preferred to be the same as that of the cleaning roller. No problem arises if there is a difference of about 5 mm on both sides for mechanical designing requirements.

The following describes the details of the components:

2-b) Cleaning blade

The cleaning blade load and its components are the same those in Embodiment 4.

2-c) Cleaning roller

The components, application potential level and polarity are the same those in Embodiment 4.

2-d) Image former

It is possible to use the image former of the conductive substrate provided with coating where the organic photoconductor is used as a photosensitive layer.

For example, the image former disclosed in Japanese Patent Laid-Open NO.216172/1989 can be used as material.

2-e) Toner

The same toner as used in the Embodiment 4 can be used.

2-f) Others

The development method can be used without any restriction as in the case of Embodiment 4.

The following Example gives more specific description of the present invention. It goes without saying that the present invention is restricted thereto.

EXAMPLE 4-1

The following describes the details of Embodiment 4 according to the present invention:

Evaluation device

The evaluation device used in the experiment has the same configuration as that of the image forming system shown in FIG. 1, and is based on the reversal development method where a latent image is formed by erasing the potential of the image section on the image former through laser exposure.

Image former lineal velocity during image formation is 240 mm/sec.

Developer

Negatively charged toner having a mean volume particle size of 6.5 microns obtained by emulsion polymerization method was used for two-component developer toner.

Image former:

An aluminum tube coated with phthalocyanine pigment as an organic photo semiconductor layer dispersed to polycarbonate was used.

The photoconductor layer including the electrical charge feed layer is 25 microns thick, with a charged potential of −750 volts on the non-image section and a potential of −100V on the darkest image portion.

Cleaning roller:

A roller made up of conductive foamed urethane having a surface resistivity of $4.5\times10^4\Omega/\square$ and a hardness of 30 deg. The peripheral speed ratio at the contact portion of the image former was approximately 1 to 1. It is rotated synchronously with the image former by a gear couple. Further, the roller is installed so that the nip width in contact with the image former is 2 mm, and is formed by winding an urethane layer on a 6 mm-diameter metallic shaft to a thickness of 4.5 mm. (roller: 15 mm in diameter)

This roller was designed to turn in the same direction as the image former at the nip section. A scraper was provided to remove the recovered toner.

Applied bias current:

The current of +20 microamperes was applied from the constant current power supply.

Figure 12:
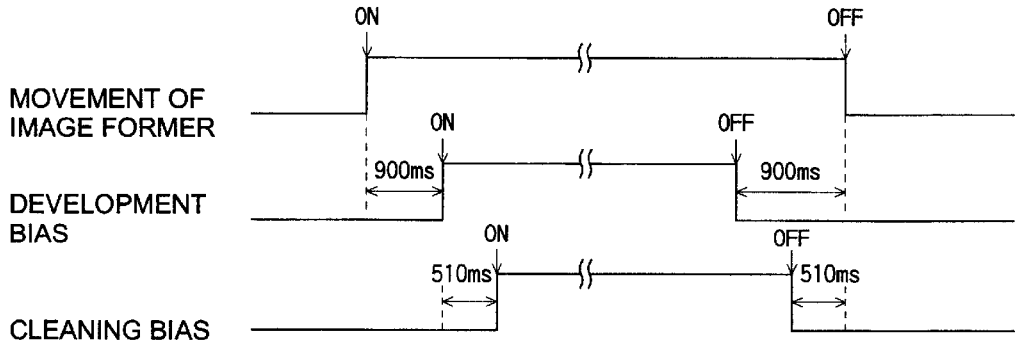
FIG. 12 is a drawing specifically illustrating the time of starting or stopping application of bias to a cleaning roller.

FIG. 12 shows the bias application timing. The bias rise time (including overshoot) and fall time each were 10 ms.

Cleaning blade:

The cleaning blade was made of urethane rubber. It had a hardness of 70 deg. with a thickness of 2.00 mm and a free length of 10 mm. This blade was installed to be in contact with the image former at an angle of 10 deg. with a contact load of 120 mN/cm.

Copying test:

Copying test of 200,000 sheets was conducted under the above conditions.

In the test, 0 to 100,000 sheets were copied at normal temperature and normal relative humidity (20° C., 50% RH), and 100,000 to 200,000 sheets were copies at high temperature and high relative humidity (30° C., 80% RH)

Up to 200,000 sheets, stable high cleaning performances were ensured without cleaning failure (escape of toner particles) or image failure such as electric discharge mark due to the cleaning roller.

EXAMPLE 5-1

The following describes the details of Embodiment 5 according to the present invention:

Evaluation device

The evaluation device is designed based on the reversal development method where a latent image is formed by erasing the potential of the image section on the image former through laser exposure.

Figure 13:
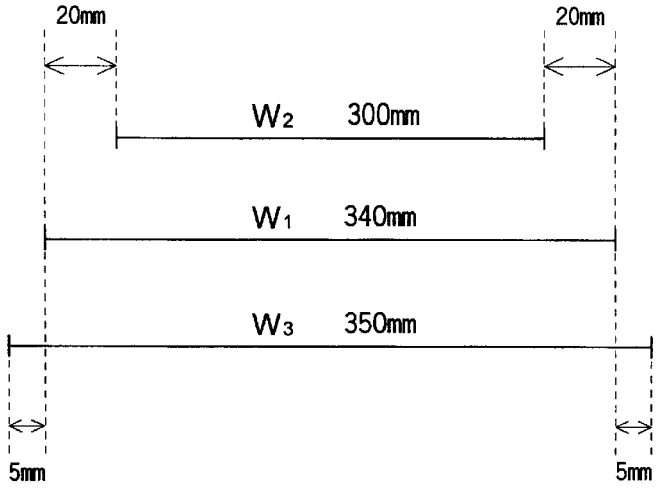
FIG. 13 is a drawing specifically illustrating the adequate width along the length of a cleaning roller.

The width of developer feed (mm) is W2, cleaning roller width is W1, width of photosensitive layer on the image former is W3, and width of cleaning blade is the same as W1, as shown in FIG. 13.

Developer

Negatively charged toner having a mean volume particle size of 6.5 microns obtained by emulsion polymerization method was used for two-component developer toner.

Image former:

An aluminum tube coated with phthalocyanine pigment as an organic photo semiconductor layer dispersed to polycarbonate was used.

The photoconductor layer including the electrical charge feed layer is 25 microns thick, with a charged potential of −750 volts on the non-image section and a potential of −100V on the darkest image portion.

Cleaning roller:

A roller made up of conductive foamed urethane having a surface resistivity of $4.0\times10^4\Omega$ and a hardness of 30 deg. The peripheral speed ratio at the contact portion of the image former was approximately 1 to 1. This roller was designed to move in the same direction as the image former at the nip portion. A scraper was provided to remove the toner. It was designed that the nip portion in contact with image former was 2 mm wide, and was formed by winding an urethane layer on a 6 mm-diameter metallic shaft to a thickness of 4.5 mm. (roller: 15 mm in diameter)

Current value of applied bias:

A current of +20 microamperes was applied from the constant current power supply.

Cleaning blade:

The cleaning blade was made of urethane rubber. It had a hardness of 70 deg. with a thickness of 2.00 mm and a free length of 10 mm. This cleaning blade was brought in contact with the image former at a contact angle of 10 deg. with a contact load of 120 mN/cm.

Copying test:

Copying test of 200,000 sheets was conducted under the above conditions.

In the test, 0 to 100,000 sheets were copied at normal temperature and normal relative humidity (20° C., 50% RH), and 100,000 to 200,000 sheets were copies at high temperature and high relative humidity (30° C., 80% RH).

Up to 200,000 sheets, stable high cleaning performances were ensured without cleaning failure, image contamination or image failure.

The Embodiment 4 of the present invention provides an image forming system which ensures stable high quality images for a long time free from damage by electric discharge.

The Embodiment 5 of the present invention provides an image forming system provided with a cleaning system which ensures stable cleaning performances for a long time, while recovering the toner extensively scattered from the development device.

[Embodiment 6]

The following describes the Embodiment 6 according to the present invention:

This description, however, is not intended to restrict the scope of the technologies or terminologies disclosed in the claims. The conclusive description of the embodiment given below shows the best mode, without restricting the meaning of the terminologies or technological range in the present invention.

Figure 14:
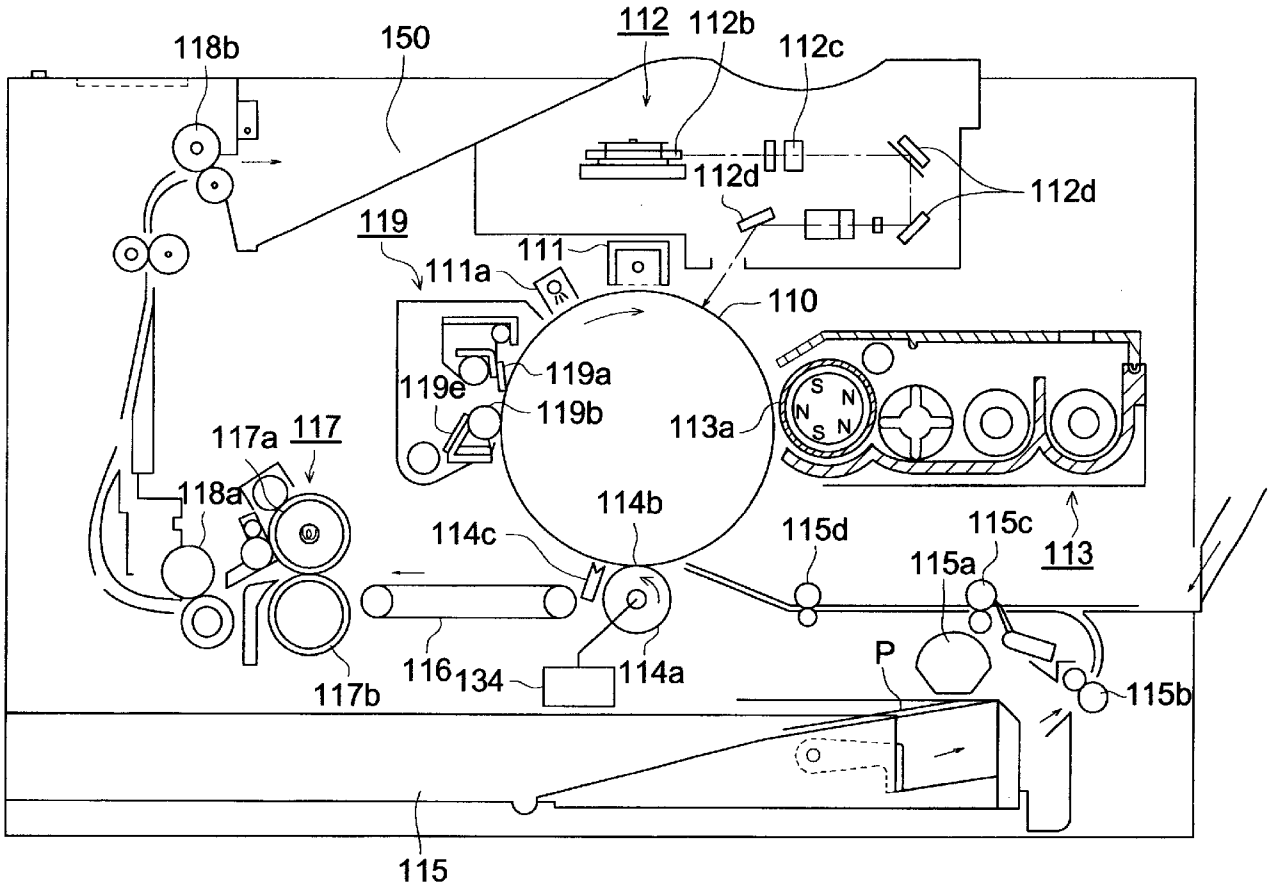
FIG. 14 is a cross sectional view representing an example of the image forming system according to the present invention.

The following describes the configuration and function of the image forming system represented by the embodiment according to the present invention with reference to FIG. 14:

In FIG. 14, numeral 110 denotes a photoconductor drum as an electrostatic latent image bearing member, For example, it is composed of a conductive drum coated with an OPC photoconductor comprising an organic photoconductive layer. It is grounded, and is driven and rotated in the clockwise direction. Numeral 111 denotes a charging device which provides uniform negative electric charging, for example, on the circumferential surface of the photoconductor drum 110 by corona discharge, thereby providing potential $V_H$. Prior to electric charging by said charging device 111, exposure is carried out by PCL 11*a* using a light emitting diode or the like in order to remove the history of the photoconductor up to the previous printing. Thus, electric charge is eliminated from the surface on around the photoconductor.

After uniform electric charging to the photoconductor drum 110, the image is exposed by the laser writer 112 based on image signal. After image signals entered from a computer or image reader have been processed by the image signal processor, data on this image exposure is entered into the laser writer 112, and an electrostatic latent image is formed on the photoconductor drum 110.

The optical path is bent by multiple reflecting mirror M 112*d* through a fθ lens 112*c* and a rotating polygon mirror 112*b* which is rotated using a laser diode (not illustrated) as a light emitting light source, and horizontal scanning of the laser writer 112 is performed. An electrostatic latent image is formed by said horizontal scanning and vertical scanning due to rotation of the photoconductor drum 110. In the present Embodiment, image section is subjected to exposure based on said image signals. Then a reversal latent image is formed and the potential of the exposure unit becomes $V_L$, where the absolute value of the potential is low.

A development device 113 is installed on the periphery of the photoconductor drum 110, wherein said development device contains negatively charged conductive toner and a built-in two-component developer composed of a magnetic carrier. Reversal development is carried out by a rotating development sleeve 113*a* which contains a built-in magnet and holds the developer.

The developer is produced in such a way that electric charge controlling agent, silica, titanium oxide or the like is added to a carrier using Ferrite as a core around which insulating resin is coated and the toner provided with such a coloring agent as pigment or carbon black, and they are mixed so that toner concentration will be from 5 to 10 wt. %, wherein said toner having a weight mean particle size (discussed later) of 3 to 10 microns. The developer is controlled to the layer thickness of 0.1 to 0.6 mm on the development sleeve 113*a*, and is fed to the development area.

The space between the development sleeve 113*a* and photoconductor drum 110 in the development area is 0.2 to 1.0 microns—a value greater than the thickness of the developer layer. The a.c. bias voltage obtained by superimposing the a.c. voltage VAC onto the d.c. voltage $V_{DC}$ is applied between the development sleeve 13*a* and photoconductor drum 110. Toner is negatively charged in the same polarity as the d.c. voltage $V_{DC}$. Accordingly, the toner provided with the chance of getting separated from the carrier by the a.c. voltage $V_{AC}$ does not deposit on the portion $V_H$ where the absolute value of the potential is higher than the d.c. voltage $V_{DC}$. The amount of toner in conformity to the potential difference is deposited on the portion $V_L$ where the absolute value of the potential is lower, thereby resulting in reversal development. Further, only the d.c. voltage $V_{DC}$ can be applied between the development sleeve 113*a* and photoconductor drum 110. Contact development can be performed as development. The photoconductor drum 110 holding the toner image performs transfer operations in the next transfer step.

The recording paper is fed to a timing roller 15*d* by a paper feed cassette 115 through a semi-circular roller 115*a* and feed rollers 115*b* and 115*c*, and is stopped there once. Then when the system is ready for transfer, said paper is fed to a transfer area 4*b* by the rotation of a timing roller 115*d*. Synchronously with transfer, a transfer roller 114*a* to which a high voltage charged in the polarity reverse to that of toner is applied by a high pressure power supply 134 is brought in contact with the circumferential surface of the photoconductor drum 110 at a transfer area 114*b*. With the fed recording paper P in-between, the toner image on the circumferential surface of the photoconductor drum 110 is transferred to the recording paper P.

Electric charge is eliminated by peak electrodes 114*c* laid out with a slight gap from the recording paper P where a toner image is transferred. Said paper is separated from the circumferential surface by means of a photoconductor drum 110, and is fed to a fusing device 117 by a feed belt 116. The transfer toner image is molten by heating and pressure of the fusing roller 117*a* as a heating roller and pressure roller and fusing roller 117*b*. After the image is fixed on the recording paper P, the paper is ejected to the tray unit 50 by the ejecting rollers 18*a* and 18*b*.

After the recording paper P has passed by, said transfer roller 14*a* is kept separated from the circumferential surface of the photoconductor drum 110 until the next image image transfer.

After having transferred the toner image to the recording paper P, the photoconductor drum 110 reaches the cleaning system 119. The greater part of toner remaining on the surface is removed by being sucked to tone recovery roller 19*b* as a toner recovery means consisting of e.g. the conductive elastic roller to which constant current bias voltage to be discussed later is applied from the constant current high voltage power supply 35. The deposited amount of toner per unit area on the photoconductor drum 10 is reduced to 0.25 mg/cm$^2$ or less. After that, the toner remaining on the circumferential surface is scraped off into the cleaning system 119 by the cleaning blade 119*a* consisting of a urethane rubber material in contact with the photoconductor drum 110. The toner moved to said toner recovery roller 119*b* by the blade 119*e* is also scraped off into the cleaning system 19 and is ejected or stored by the screw or the like.

The photoconductor drum 110 from which the remaining toner has been removed by the cleaning system 119 is exposed by the PC L 111*a*. Then it is uniformly charged by a charging device 111, and the next image formation cycle.

Toner of the developer used in the image forming system of said the present invention, for example, is polymerized toner produced by emulsion polymerization association method, and has an approximately circular form with a mean circularity of 0.96 to 0.99.

The mean circularity hereunder can be defined by a means value of m/M where M represents the circumferential length of the projected image of the toner particle, and m denotes the circumferential length of the equivalent circle having the same area as that of the projected image of the toner particle. Circularity is 1 when the particle image is truly circular, and the value is smaller as the particle image is more slender or more irregular in shape.

Polymerized toner is produced by emulsion polymerization association method as follows: The surfactant is used to to disperse coloring agent in water. In the meantime, surfactant, emulsion polymerization initiator, styrene monomer and acryl monomer are placed in water to produce resin emulsion by emulsion polymerization. Then said coloring agent dispersant and resin emulsion are mixed. While keeping balance between the repulsive force of the particles surface generated by PH regulation and coagulation force by addition of electrolyte, gradual coagulation is carried out. Association is allowed to take place while controlling particle size and particle size distribution, and heating and agitation are implemented at the same time. In this manner, inter-particle fusing and shape control are performed.

In this case, inter-particle fusing and shape control is implemented using an agitation tank designed to ensure that agitation is carried out in a laminar flow free from turbulent flow. For example, in this case, a flow type particle image analyzer FPIA-2000 (by Toa Medical Electronics) is used to measure the mean circularity. This analyzer allows the shape of the particle to be monitored during generation of toner particles. So reaction can be stopped when a desired mean circularity and weight mean particle size has been obtained. Obtained particles are filtered, cleaned and dried, thereby getting toner particles having a mean circularity of 0,96 to 0.99 and a weight mean particle size (D50) of 3 to 10 microns.

In the present Embodiment, the weight mean particle size (D50) was measured by the Coulter Counter TA-II (by Coulter).

Toner obtained in said manner according to emulsion polymerization association method is characterized by a sharp distribution of particle size and a small amount of fine particles, very small contamination of the carrier by toner ("Toner spent"), excellent developer durability and uniform distribution of charged amount. Images of high quality are ensured as compared to those obtained from the conventional pulverization system.

Figure 15:
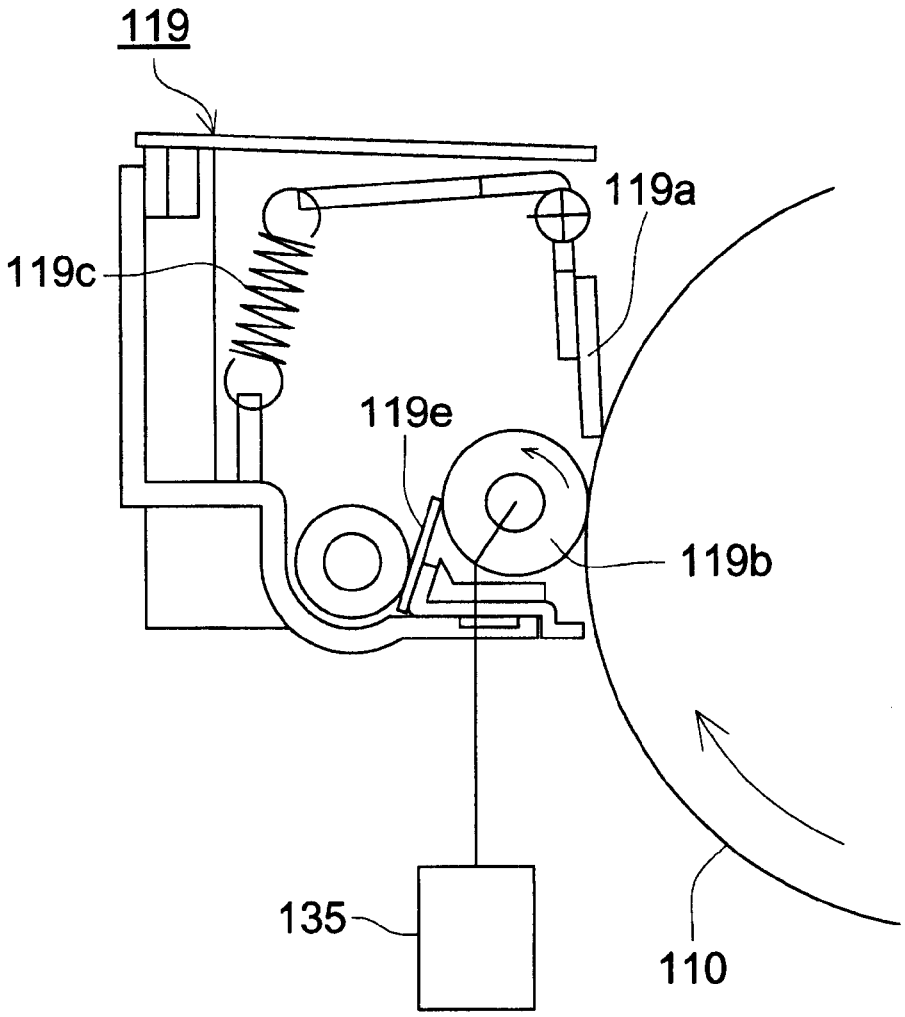
FIG. 15 is a cross sectional view representing an example of the cleaning system shown in FIG. 14 according to the present invention.

FIG. 15 is a cross sectional view representing an example of the cleaning system of the image forming system shown in FIG. 14 according to the present invention;

In FIG. 15, numeral 110 denotes a photoconductor drum, and 119 indicates a cleaning system. Numeral 119*a* represents a cleaning blade comprising a urethane rubber having a rubber hardness of JISA 69 deg., a free length of 9 mm and a thickness of 2 mm, and 119*b* denotes a 15 mm-diameter conductive and elastic toner recovery means which is a toner recovery roller made of conductive urethane comprising a RUBISEL roller having a hardness Ascar C 32 deg. (by Toyo Polymer), for example. Numeral 119*c* indicates an energizing member such as a spring, and 119*e* denotes a blade to scrape off the toner having moved onto the toner recovery roller 119*b*.

Cleaning blade 119*a* is an elastic blade installed in a counter form. It is brought in contact with the surface of the photoconductor drum 110 by means of an energizing member 119*c* so that normal load is 20 to 22 mN/cm. The toner recovery roller 119*b* is brought in light contact with the surface of the photoconductor drum 110, and follows the rotation of the photoconductor drum 110. Voltage of the reverse polarity to toner is applied to the recovery roller 119*b* from thee constant current high voltage power supply 135 of the constant current control. Constant current bias voltage is applied to ensure that the remaining toner passing through without being recovered by the toner recovery roller 119*b* will not exceed 0.25 mg/cm$^2$.

Figure 16:
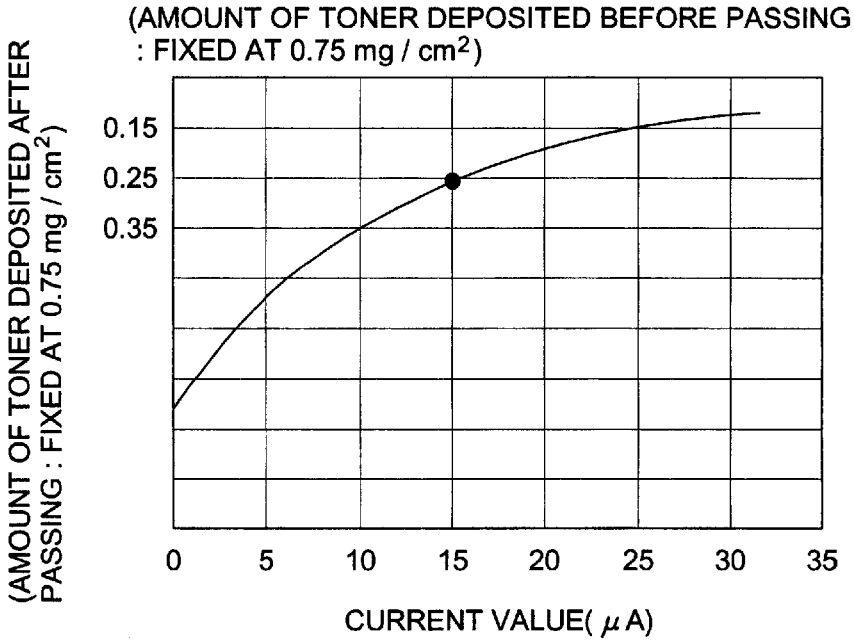
FIG. 16 is a chart representing the relation between the current value of bias voltage applied to the toner recovery roller and the amount of deposited toner after passing.

FIG. 16 is a chart representing the relation of the amount of deposited toner passing through without being recovered by the toner recovery roller 119*b* when the amount of deposited toner of 0.75 mg/cm$^2$ per area corresponding to untransferred solid black where the amount of toner deposited on the surface of the photoconductor drum 110 is the maximum is fixed unchanged, and the current value of the constant current bias voltage to be applied to the toner recovery roller 119*b* is changed. FIG. 16 shows that constant current bias voltage of 15 microamperes or more must be applied in order to ensure that the amount of toner deposited after passing through the toner recovery roller 119*b* does not exceed 0.25 mg/cm$^2$. In the present Embodiment, constant current bias voltage of 15 microamperes or more is applied, thereby ensuring that the amount of deposited toner on the photoconductor drum 110 passing through the recovery roller 119*b* and reaching the cleaning blade 119*a* does not exceed 0.25 mg/cm$^2$.

(Test 1)

Using the polymerized toner having a mean circularity of 0.97 and a weight mean particle size (D50) of 6 microns, the amount of deposited toner on the photoconductor drum 110 passing through the recovery roller 119*b* and reaching the cleaning blade 119*a* was changed in the following order; 0.60, 0.53, . . . , 0.20, 0.10 mg/cm$^2$ or less. In this case, a test was made to check if cleaning by the cleaning blade 119*a* was satisfactory or not. The result of this test is given in Table 1.

TABLE 1

| Blade life | 0 kP | 5 kP | 10 kP | 20 kP | 35 kP | 60 kP | 80 kP | 110 kP | Remarks |
|---|---|---|---|---|---|---|---|---|---|
| Drum life Amount of toner deposited on drum | 0 kP | 5 kP | 10 kP | 20 kP | 35 kP | 60 kP | 80 kP | 110 kP | |
| 0.60 | AAA | XXX | XXX | XXX | XXX | XXX | XXX | XXX | Not the present invention |
| 0.53 | AAA | AXX | XXX | XXX | XXX | XXX | XXX | XXX | Not the present invention |
| 0.42 | AAA | AAA | XXA | XXX | XXX | XXX | XXX | XXX | Not the present invention |
| 0.27 | AAA | AAA | AAA | AAA | XAX | XXA | XAX | AXX | Not the present invention |
| 0.25 | AAA | AAA | AAA | AAA | AAA | AAA | AAA | AAA | Present invention |
| 0.20 | AAA | AAA | AAA | AAA | AAA | AAA | AAA | AAA | Present invention |
| 0.10 | AAA | AAA | AAA | AAA | AAA | AAA | AAA | AAA | Present invention |

Amounts of toner deposited are given in terms of mg/cm$^2$.

Cleaning failure occurs if toner passes through the edge of the cleaning blade 119*a* (escape of toner particles) at the time of cleaning. To check if this phenomenon occurred or not, the photoconductor portion having passed through the blade was transferred to the white paper (A4-sized transfer paper), and contamination on the white paper having transferred was checked. If it was contaminated, the contamination was considered to be caused by the toner which had passed through the blade to be deposited on the photoconductor. This is indicated by "X". By contrast, if there was no contamination on the white paper having been transferred, "A" is used to represent this state. The test was carried out, for example, by transferring to three sheets of white paper for each 10 kP (10,000 prints) and 20 kP. The result is clear from Table 1. If the remaining toner reaching the cleaning blade 119*a* does not exceed 0.25 mg/cm$^2$, escape of toner particles did not occur until 110 kP was reached, and excellent cleaning continued, as is clear from Table 1.

(Test 2)

The inventors of the present invention prepared 15 types of toner as combinations of five types of mean circularity; 0.95, 0.96, 0.97, 0.99, and 1.00 and three weight mean particle sizes; 3, 6 and 10 microns. The amount of deposited toner on the photoconductor drum 110 having passed through the recovery roller 119*b* and reached the cleaning blade 119*a* was adjusted not to exceed 0.20, 0.25, . . . , 0.27 microns per unit area. 110 kP printing test was conducted using image forming system shown in FIG. 1. Table 2 shows the result of this test.

TABLE 2

| Amount of toner deposited before blade | Toner: Average circularity | Toner: Weight mean particle size | Cleaning performance | Image quality | Remarks |
|---|---|---|---|---|---|
| 0.20 | 0.95 | 3 | good | passable | (1) Not the |
| | | 6 | good | passable | present |
| | | 10 | good | passable | invention |
| | 0.96 | 3 | good | good | (2) Not the |
| | | 6 | good | good | present |
| | | 10 | good | good | invention |
| | 0.97 | 3 | good | good | (3) Not the |
| | | 6 | good | good | present |
| | | 10 | good | good | invention |
| | 0.99 | 3 | good | good | (4) Not the |
| | | 6 | good | good | present |
| | | 10 | good | good | invention |
| | 1.00 | 3 | bad | bad | (5) Not the |
| | | 6 | passable | passable | present |
| | | 10 | good | good | invention |
| 0.25 | 0.97 | 3 | good | good | (6) Not the |
| | | 6 | good | good | present |
| | | 10 | good | good | invention |
| 0.27 | 0.97 | 3 | bad | bad | (7) Not the |
| | | 6 | passable | passable | present |
| | | 10 | good | good | invention |

Amounts of toner deposited are given in terms of mg/cm$^2$.
Weight mean particle sizes are given in microns.

In each test, where 110 kP printing had passed, 10 sheets of A4-sized print transfer paper were picked up at random and evaluation was made from the view point of both cleaning performance and image quality. A term of "good" is used to show that there was no defect, while a term of "bad" was used to indicate that such a defect as fogging or toner contamination was found out by visual observation. A defect found out by using a loupe is marked with "passable". Cleaning performance is directly related to image quality. When cleaning performance was found unsatisfactory, image quality failure was also observed.

Adjustment was made so that the amount of deposited toner immediately before the cleaning blade 119*a* did not exceed 0.20 mg/cm$^2$, and tests <2>, <3> and <4> were conducted using three types of mean circularity; 0.96, 0.97, and 0.99. These tests revealed that both cleaning performance and image quality were satisfactory.

Adjustment was made so that the amount of deposited toner immediately before the cleaning blade 119*a* did not exceed 0.25 mg/cm$^2$, and test <6> was conducted using the mean circularity of 0.97. This test revealed that both cleaning performance and image quality were satisfactory. The results of tests <2>, <3> <4> and <6> in the present invention were satisfactory in both cleaning performance and image quality.

Further, adjustment was made to ensure that the amount of deposited toner immediately before the cleaning blade 119*a* did not exceed 0.20 mg/cm$^2$, and test <1> was conducted using the mean circularity of 0.95. The test revealed that cleaning performance was satisfactory without any problem, but irregularities on image surface probably caused by development were found out.

Adjustment was made so that the amount of deposited toner immediately before the cleaning blade 119*a* did not exceed 0.20 mg/cm$^2$, and test <5> was conducted using the mean circularity of 1.00. In this test cleaning failure was detected, and fogging phenomenon was observed. This phenomenon occurred especially when small-diameter toner particles having a weight mean particle size of 3 microns were used. Probably some of them passed through the blade, resulting in this phenomenon.

In the test <1> using the toner with a mean circularity of 0.95 outside the scope of the present invention, failure was observed in image quality. In the test <5> using the toner with a mean circularity of 1.00, cleaning failure was found out.

Adjustment was made to ensure that the amount of deposited toner immediately before the cleaning blade 119*a* did not exceed 0.27 mg/cm$^2$, and test <7> was conducted using the mean circularity of 0.97. In this test, cleaning failure was observed. Fogging phenomenon and toner contamination were observed especially when small-diameter toner particles having a weight mean particle size of 3 microns were used.

Cleaning failure was detected in the test <7> outside the scope of the present invention where the amount of deposited toner immediately before the cleaning blade 119*a* did not exceed 0.27 mg/cm$^2$.

In said Tests 1 and 2 have made it clear that cleaning is performed in an image forming system illustrated in FIG. 14 using the toner with a mean circularity of 0.96 to 0.99, wherein toner deposited on the photoconductor drum 110 having passed through the toner recovery roller 119*b* and having reached the cleaning blade 119*a* was adjusted not to exceed 0.25 mg/cm$^2$. Said Tests 1 and 2 have made it clear that high quality image without cleaning failure can be obtained even if printing is performed up to 110 kP. It has also been made clear that high quality image is provided by toner having a weight mean particle diameter of 3 to 10 microns.

Thus, an image forming system is equipped with a cleaning system 119 wherein constant current bias voltage having a current of 15 microamperes or more is applied to the toner recovery roller 119*b* by the constant current high voltage power supply 135. In this system, the surface of the photoconductor drum 110 reaches the cleaning system 119 after a formed toner image is transferred onto the recording paper P, and toner image remaining untransferred due to jamming or other reasons reaches the cleaning system 119. In this case, the remaining toner is fed to the toner recovery roller 19*b* by bias voltage applied to the remaining toner recovery roller 119*b*, and is reduced so that the amount of deposited toner does not exceed 0.25 mg/cm$^2$. Then the remaining toner is scraped off by the cleaning blade 119*a*, and is completely cleaned. The toner having moved to said toner recovery roller 119*d* is scraped off by the blade 119*e*, and ejected or stored into a toner waste storage tank (not illustrated) by the screw or the like together with the toner having been scraped off by said cleaning blade 119*a*.

Figure 17:
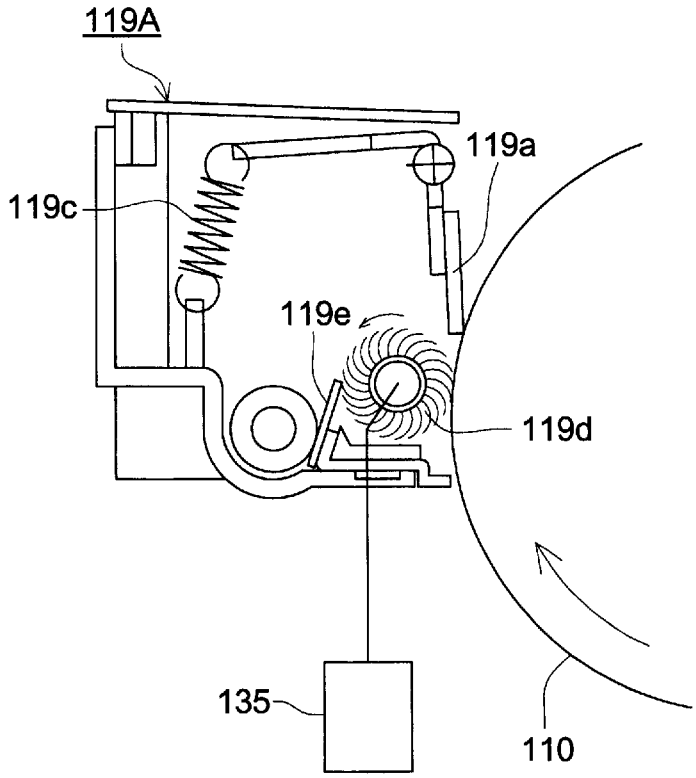
FIG. 17 is a cross sectional view representing the configuration of another example of the cleaning system.

FIG. 17 is a cross sectional view representing the configuration of another example of a cleaning system 119A in the image forming system according to the present invention.

In FIG. 17, the portions having the same numeric codes as those of the cleaning system 19 of FIG. 15 have the same functions; so they are not included in the following detailed description. Numeral 119*d* denotes a toner recovery fur brush as an toner recovery means. It is a toner recovery fur brush for toner collection, for example, consisting of the conductive viscose rayon REC, SH (300/100, D/F, 224 kF/inch$^2$) by Toa Sangyo, having a shaft diameter of 11 mm and brush diameter of 20 mm with 4.5 mm-long hair around the shaft.

The hair tip of the toner recovery fur brush 119*d* lightly contacts the surface of the photoconductor drum 110, and the contact portion is rotated by electric power (not illustrated) in the same direction as the photoconductor drum 110. Bias voltage of constant current having a current value of 15 microamperes or more, for example, is applied to the toner recovery fur brush 119*d* by means of a constant current high voltage power supply 135, as in the case of said toner recovery roller 19*b* illustrated in FIG. 15.

In the image forming system equipped with said cleaning system 119 the surface of the photoconductor drum 110 reaches the cleaning system 119 after a formed toner image is transferred onto the recording paper P, and toner image remaining untransferred due to jamming or other reasons reaches the cleaning system 119. In this case, the remaining toner is reduced so that the amount of deposited toner does not exceed 0.25 mg/cm$^2$. So the remaining toner is scraped off by the cleaning blade 119*a* without escape of toner particles, thereby ensuring perfect cleaning. The toner having moved to said toner recovery fur brush 119*b* is scraped off by the blade 119*e*, and is ejected or stored into a toner waste storage tank (not illustrated) by the screw or the like together with the toner having been scraped off by said cleaning blade 119*a*.

The present invention according to Embodiment 6 provides an image forming method and image forming system which ensure excellent images for a long time without toner passing through the cleaning blade despite the use of approximately circular toner of small particle size, or without deterioration of cleaning performance. This makes it possible to provide an image forming system characterized by high quality printing without particles being noticeable.

[Embodiment 7]

Figure 18:
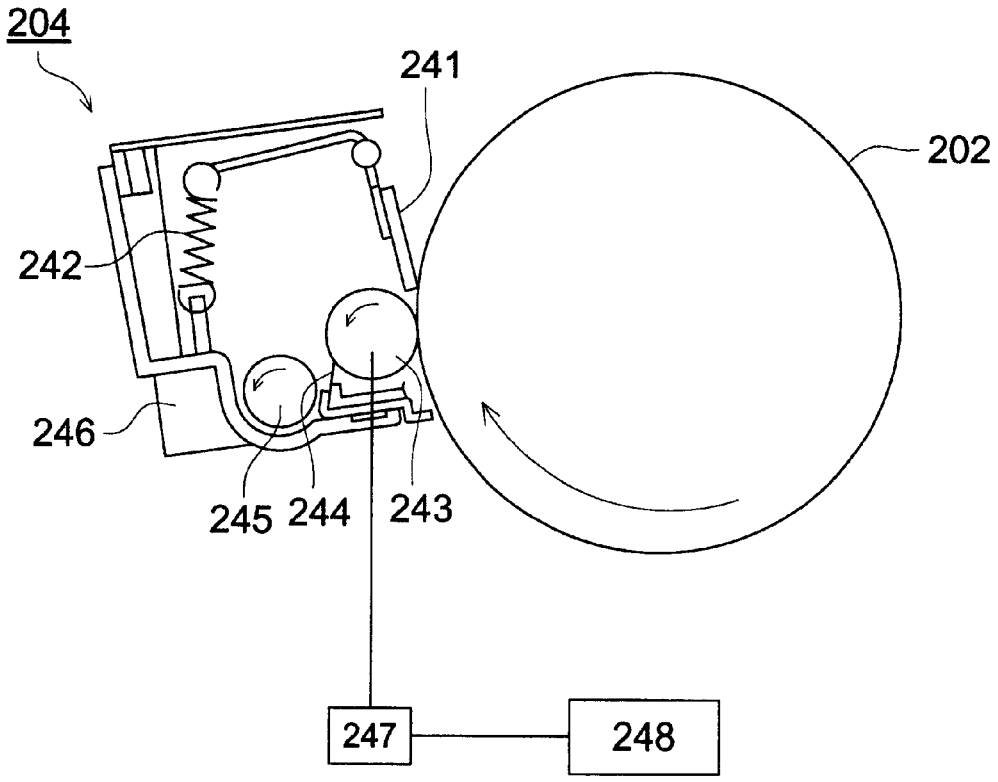
FIG. 18 is a schematic drawing representing the relation between the cleaning system and image bearing member according to the present invention.

The following describes the Embodiment 7 according to the present invention with reference to drawings, without being restricted thereto:

FIG. 18 is a schematic drawing representing the relation between the cleaning system and image bearing member according to the present invention. Numeral 202 denotes a photoconductor drum as an image bearing member, and 204 indicates a cleaning system. Numeral 241 shows a cleaning blade which performs cleaning by the pressure through contact with the end to a photoconductor drum 202, and 242 denotes a spring to energize the cleaning blade 241 to contact the photoconductor drum 202. Numeral 243 represents a cleaning roller which is subjected to bias application and gets in contact with said photoconductor drum 202 through rotation, thereby removing toner and cleaning the photoconductor drum 202 electrostatically. Numeral 244 indicates a blade to scrape off the toner from the cleaning roller 443, and 245 shows a toner recover roller which collects the toner removed from the cleaning roller 243 by the blade 244 and feeds it to a recycling pipe (not illustrated) connected to the development device. Numeral 246 denotes a housing of the cleaning system 4, 247 a power supply as an bias voltage application means for application of bias voltage to the cleaning roller 243, and 248 a power supply controller as a control means for constant current control the power supply 247.

Said cleaning roller 243 gets in contact with the photoconductor drum 202 to suck and remove the toner electrostatically. Bias voltage applied to the cleaning roller 243 is required to have the polarity reverse to that of the toner on the photoconductor drum 202 at the position in contact with the cleaning roller 243. In other words, the power supply 247 applies positive bias voltage to the cleaning roller 243 when toner is negatively charged, and applies negative bias voltage when toner is positively charged. For example, when the photoconductor drum 202 is an OPC photoconductor (organic photoconductor), toner is negatively charged, so positive bias voltage is applied. In this case, applied bias voltage is subjected to constant current control by a power supply controller 248. Constant current control allows a constant voltage to be applied to the toner per unit amount, independently of the amount of remaining toner deposited onto the photoconductor drum 202. Uniform suction and removal of toner is ensured despite difference in the amount of deposit according to different positions. This is a great advantage. A preferable constant current value under constant current control is approximately 5 to 30 microamperes although it varies with the performances and properties of the image bearing member or cleaning system.

If the photoconductor drum 202 turns in the arrow marked direction, the cleaning roller 243 located on the upstream side of the cleaning system 204 with bias voltage applied thereto is brought in contact with the photoconductor drum 202. The cleaning roller 243 rotates in the arrow marked direction without opposing the rotation of the photoconductor drum 202, and electrostatically attracts on its surface the remaining toner deposited on the photoconductor drum 202 and foreign substances such as paper powder. The toner sucked and deposited on the cleaning roller 243 reaches the blade 244 through further rotation. Then it is escaped off by the blade 244, and said scraped toner is led into the recycling pipe (not illustrated) by the rotation of the toner recovery roller 245 to be reused as development toner. The photoconductor drum 202 makes further rotation until the tip of the cleaning blade 41 reaches the contract position. Then remaining toner and others are scraped off, and removed toner and others are led into the recycling pipe by the toner recovery roller 45, as in the case of said cleaning roller 243. As the cleaning blade 241 wears and deteriorates, a gap may be formed between the blade and photoconductor drum 202, from which toner may escape. However, such toner is again sucked and removed by the cleaning roller 243 located on the upstream side of the cleaning blade 241. Thus, the cleaning capacity of the cleaning system 204 is not reduced by the lapse of time. This ensures continued cleaning of the image bearing member sufficiently.

The cleaning roller 243 is preferred to be a conductive elastic roller. In order that bias voltage is applied to the cleaning roller 243 and effective electrostatic suction of toner from the photoconductor drum 202 is provided, the surface resistivity of the cleaning roller 243 is preferred to be such that electric conductivity is within the range from $10^5\Omega$ to $10^8\Omega$.

Further, even if foreign substances are caught between the roller and photoconductor drum 202, for example, toner can be brought into the cleaning system 204 without the surface of the photoconductor drum 202 being damaged, when the cleaning roller 243 is elastic. Also if the cleaning roller 243 is elastic, the contact with photoconductor drum 202 is increased. Thus, electrostatic suction not only allows toner to be removed from the photoconductor drum 202, but also provides a wiping effect, thereby further improving cleaning capacity. When the cleaning roller 243 is elastic, preferred surface hardness is Ascar C 20 to 40 deg.

To put it more specifically, a RUBISEL roller (with a hardness of Ascar C 32 dg.) by Toyo Polymer can be given as a preferred conductive elastic roller.

Figure 19:
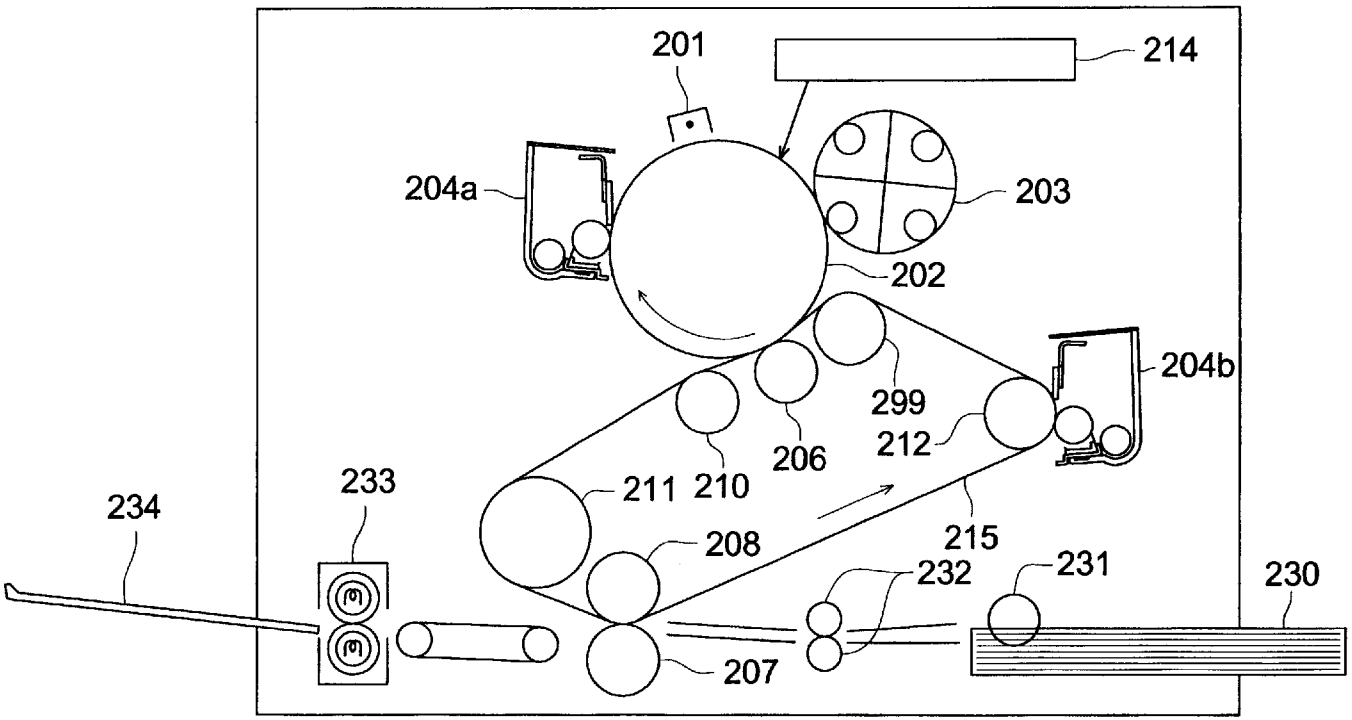
FIG. 19 is a schematic drawing representing a laser printer as an example of the image forming system equipped with the cleaning system according to the present invention.

FIG. 19 is a schematic drawing representing a laser printer as an example of the image forming system equipped with the cleaning system according to the present invention.

In FIG. 19, numeral 101 denotes a charging device, 202 a photoconductor drum as a first image bearing member, and 203 a development drum with four development devices (development means). Numeral 204*a* indicates a photoconductor cleaning system for cleaning of the photoconductor drum 202, and 404*b* shows an intermediate transfer belt cleaning system for cleaning of the intermediate transfer belt. Numeral 206 represents a primary transfer roller, 207 a secondary transfer roller, and 208 a back up roller. Numerals 209, 210, 211 and 212 denotes support rollers, 214 a laser exposure device, 215 an intermediate transfer belt as a second image bearing member, 230 a paper feed cassette to store transfer paper P, and 231 a pick up roller 232 to feed out transfer paper P. Numeral 232 indicates a resist roller, 233 a fusing device to heat and fuse the toner image on the transfer paper P having been subjected to secondary transfer, and 234 an eject tray to eject the transfer paper P having been subjected to image formation. Here the photoconductor cleaning system 404*a* and intermediate transfer belt cleaning system 204*b* constitute a cleaning system 4 according to the present invention described with reference to FIG. 18.

The following items are arranged in that order around the photoconductor drum 202; (1) a charging device 201 which provides the surface of the photoconductor drum 202 with a uniform electrical charging of a specified polarity, (2) a laser exposure device 214 for uniform writing of an electrostatic latent image on the photoconductor drum 202, (3) a development drum 203 to deposit toner to said electrostatic latent image to form a toner image, (4) a primary transfer roller 206 (conductive) to transfer a toner image on said photoconductor drum 202 to the intermediate transfer belt 215.

The photoconductor drum 202 is rotated by a drum drive motor (not illustrated) in the arrow marked direction shown in the drawing. A charger 201 is a charged electrode such as Control, and is designed to allow the photoconductor drum 2 to be uniformly charged. When the photoconductor drum 202 is an OPC photoconductor (organic photoconductor), the photoconductor drum 202 is negatively charged uniformly.

Image signals transmitted from an image reading unit for a scanner (not illustrated) and the like or personal computer are subjected to a specified processing at an image processor (not illustrated), and are sent to a laser exposure device 214. Said laser exposure device 214 scans and exposes the laser beam in conformity to said image signals on the photoconductor drum 202. As a result, the negatively charged potential of the photoconductor drum 202 are subjected to uniform damping to form an electrostatic latent image.

Said electrostatic latent image formed on the photoconductor drum 202 is developed by the toner in the first color development device out of development drum 203 equipped with four developers, and the first color toner image is formed. In this case, toner is negatively charged in said development device, and said toner is deposited on the portion where charged potential on photoconductor drum 202 is damped. Thus, the image is made visible. Said toner image carried by the photoconductor drum 202 is fed by further rotation of the photoconductor drum 202 to the primary transfer position where a primary transfer roller 206 is arranged. The toner image is primarily transferred on the intermediate transfer belt 215. The intermediate transfer belt 215 moves in the arrow marked direction shown in the drawing at almost the same speed with the photoconductor drum 202. At said primary transfer position, the image is primarily transferred to the intermediate transfer belt 15 by transfer electric field having the characteristic reverse to that of said toner applied to the primary transfer roller (positive polarity in this case).

Then the step from said latent image formation to primary toner transfer is repeated for each of the second, third and fourth colors. Color toner image with multiple colors superimposed thereon is formed on the intermediate transfer belt 215. Normally, there are four toner colors; black, yellow, magenta and cyan. They are contained to four development devices in the development drum 203. Until said color toner image is completed, the secondary transfer roller 7 and intermediate transfer belt cleaning system 4*b* are retracted from the intermediate transfer belt 15, and remain in the state of non-contact. In the present Embodiment, a development drum incorporating multiple development means was used in the formation of a color toner image. However, it is also possible to use so-called tandem method, wherein the photoconductor drum, development device and other image formation units are arranged for each color, and multiple image formation units are arranged in one row on the intermediate transfer belt 215, with each of them providing a primary transfer of the toner image to the intermediate transfer belt 15.

The remaining toner is scraped off by the photoconductor cleaning system 4*a* from the photoconductor drum 202 having transferred the toner image to the intermediate transfer belt 215 at the primary transfer position in said manner. Potential on the photoconductor drum 2 is canceled by an electric charge eliminator (not illustrated), and preparation is thus made for the next image formation.

In the meantime, primary transfer of a color toner image to the intermediate transfer belt 215 is completed and said color toner image is fed to the secondary transfer position where a secondary transfer roller 207 is installed. At this time, transfer paper P as a recording material is picked up by a pick up roller 231 from a paper feed cassette 230. The picked up transfer paper P is fed out by the resist roller 232 at a specified timing, and is fed to the secondary transfer position by the intermediate transfer belt 215 supported by a back up roller 208 and a secondary transfer roller 207 (left in the drawing). Bias potential with the polarity reverse to that of the toner on the intermediate transfer belt 15 is applied to the secondary transfer roller 207 (not illustrated). The back up roller 208 is grounded (not illustrated). So when the transfer paper P has passed between the secondary transfer roller 207 and intermediate transfer belt 215, by the transfer electric field formed at a transfer voltage with polarity reverse to the charged polarity of said toner image. Toner image carried on the intermediate transfer belt 215 is transferred to the transfer paper P. In this case, it goes without saying that the relation between the bias application of the secondary transfer roller 207 and back up roller 208 and the ground may be opposite. The transfer paper P to which the toner image is transferred secondarily is further fed to a fusing device 233 comprising a pair of heating rollers, where it is heated, pressed and fused, and is discharged into the paper eject tray 234.

In the meantime, the remaining toner or paper powder is removed from the intermediate transfer belt 125 after secondary transfer by an intermediate transfer belt cleaning system 204*b*, and preparation is thus made for the next image formation.

Each of the operations and sequence controls for said image formation is performed by a control unit (not illustrated).

The following describes the toner having a mean circularity of 0.96 or more which is to be removed by the cleaning system according to the present invention:

The known type of the toner having a mean circularity of 0.96 or more is the one formed by polymerization method. A particularly excellent production art is the polymerization method for producing polymerized toner through association between resin particles and coloring agent particles disclosed in the Official Gazette of Japanese Patent Laid-open NO. 186253/1.

Many other toner production arts based on association (fusing) of resin particles have been disclosed. Measurement of polymerized toner circularity is not restricted. However, use of a particle image analyzer FPIA-2000 (by Toa Medical Electronics) is preferable. This device is suited for monitoring of a shape by real-time image processing while allowing the liquid sample to pass by.

Figure 20:
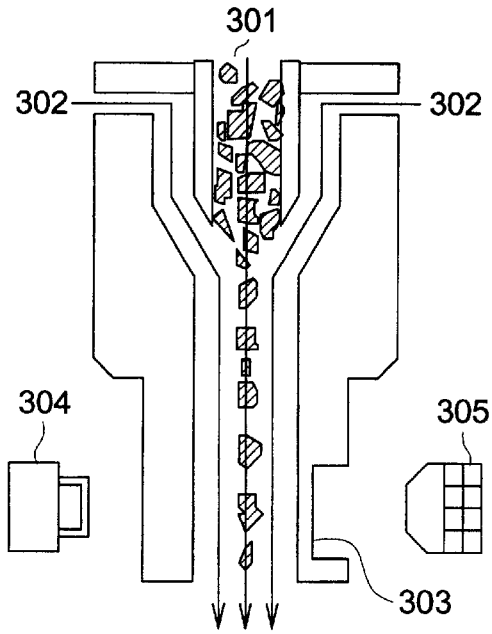
FIG. 20 is a drawing representing the shape of toner particles and major portions of a shape distribution measuring instrument.
Figure 21:
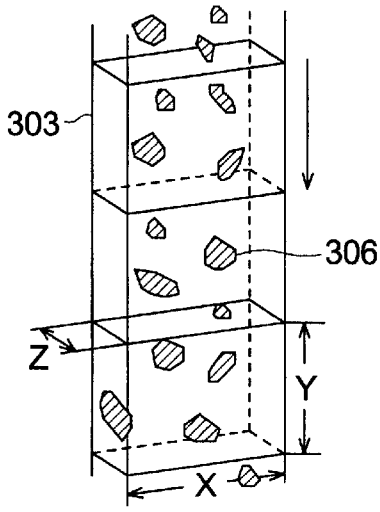
FIG. 21 is a perspective view illustrating the photographing unit in FIG. 21 and the flow of liquid sample.
Figure 22:
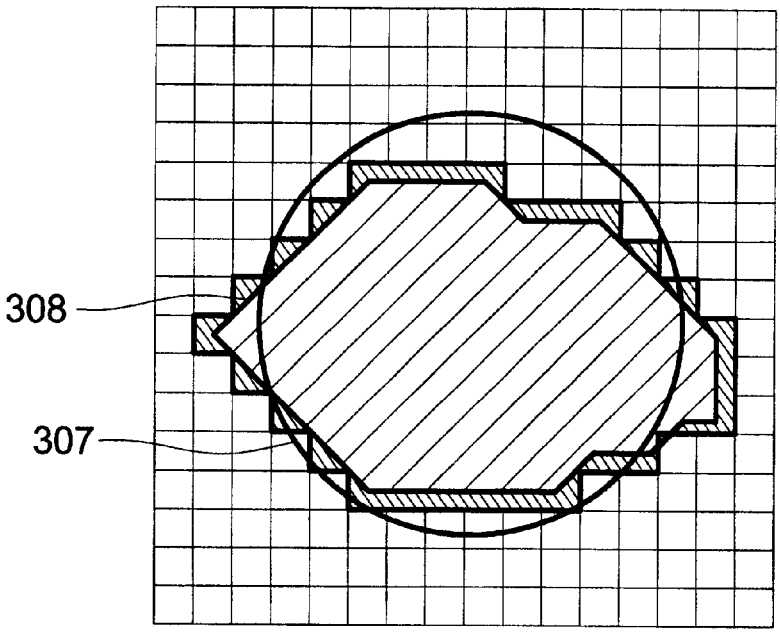
FIG. 22 is a drawing representing how to obtain circularity.

FIG. 20 is a drawing representing the shape of toner particles and major portions of a shape distribution measuring instrument. FIG. 21 is a perspective view illustrating the photographing unit in FIG. 21 and the flow of liquid sample. Further, FIG. 22 is a drawing representing how to obtain circularity.

In FIGS. 20 and 21, the arrow mark shows the flow of the liquid sample 301 or sheath solution, and 302 indicates sheath solution (coating solution). This allows the particles to go to the photographing unit 303 without being overlapped with one another. In conformity to the flashing of a stroboscope 304, a liquid sample 301 is photographed by a high speed video camera 305. Numeral 306 denotes particles in the liquid sample, and Y, Y and Z indicate longitudinal and lateral length and thickness of the photographing unit 303. FIG. 22 shows how to obtain the "circumstantial length of a circle obtained from circle-equivalent diameter of the particles photographed in this way" 307 and "circumferential length of the particle projection" 308.

Circularity can be defined as follows:

Circularity=(Circumstantial length of a circle obtained from circle-equivalent diameter)/(circumferential length of the particle projection)

In the present invention, the mean value of toner circularity (mean circularity) is preferred to be within the range from 0.96 to 0.99.

If circularity is too small, attrition may be caused by stress due to agitation in the development device, and deposition on the carrier and development device may occur, resulting in reduced durability. If circularity is too high, a spherical shape may be produced to deteriorate cleaning performances.

Further, the standard deviation for numeral level is preferred not be exceed 0.05. If it exceeds 0.05, distribution will occur to development performance due to expanded shape distribution, and selective development will take place with the result that long-term stable development cannot be ensured. So-called fogging and changes in image concentration may be observed.

The particle size of toner is measured in terms of volume. It can be obtained by the method for measuring the frequency distribution based on the logarithm-converted scale using the circle-equivalent diameter. The volume mean particle size is preferred to be within the range from 3 to 9 microns. Particle size distribution can also be measured by said measuring instrument simultaneously.

The method for producing toner having a circularity of 0.96 or more is not restricted to said method. A preferred way is to form particles in conformity to the method disclosed in the Official Gazette of Japanese Patent Laid-Open NO. 265252/1993, Official Gazette of Japanese Patent Laid-Open NO. 329947/1994 and Official Gazette of Japanese Patent Laid-Open NO. 15904/1997. After that, formed particles is subjected to heat treatment.

EXAMPLE 7-1

An image formation test was conducted on the polymerized toner having a mean circularity of 0.973, using an image forming system according to the present invention wherein a cleaning system 204 shown in FIG. 18 is arranged as a photoconductor cleaning system 204*a* for the laser printer shown in FIG. 19. Similarly, another image formation test was conducted on the polymerized toner with a mean circularity of 0.973, using an image forming system for comparison wherein a cleaning system according to the conventional technology equipped with only a cleaning blade without cleaning roller was arranged as a photoconductor cleaning system 204*a* of laser printer shown in FIG. 19. The printing count was set to zero when each of the new cleaning systems was installed, and a running printing test was conducted. Then evaluation was made to check if the cleaning performance was deteriorated with the lapse of time.

The cleaning system of the image forming system used for comparison is the same as the cleaning system 204 of Embodiment 7 shown in FIG. 18 except that a cleaning roller 243, blade 244, power supply 247 or power supply controller 248 is not provided.

In the image forming system according to the present invention, a RUBISEL roller (with a hardness of Ascar C 32 dg.) by Toyo Polymer was used as a cleaning roller 243 of the cleaning system. Bias voltage fed from the power supply 247 was placed under constant current control at a constant current value of 20 microamperes by power supply controller 248.

In said image forming system of the present invention and image forming system for comparison, the cleaning performance of the photoconductor drum 202 by a photoconductor cleaning system was evaluated as follows: Untransferred toner image (without primary transfer onto the intermediate transfer belt) on the full page of the A4-sized paper (solid filled) formed on each photoconductor drum 202 is cleaned by each cleaning system. This cleaning operation was repeated 10 times (one cycle). After that, visual observation was made to check whether or not there is any toner remaining on the photoconductor drum 202. A symbol of "X" is used to show that toner remained, while a symbol of "A" (o) is used to indicate that cleaning was satisfactory without toner remaining.

A total printing count is assumed to be the number of sheets for image formation from the printing count of zero in installation of a new cleaning system to the secondary transfer to the transfer paper. After the total print count shown in Tables 3 and 4 has been reached, according to the above-mentioned evaluation procedure, two cycles of formation and cleaning of untransferred toner image on the A4-sized full page each were carried out, wherein the amount of deposited toner is changed as given in Tables 3 and 4. All the results are given in Tables 3 and 4. Table 3 shows the image forming system for comparison, while Table 4 shows the result of evaluating the image forming system according to the present invention.

TABLE 3

| Comparison | | | | | | | |
|---|---|---|---|---|---|---|---|
| Total count of printing | 0 | 12000 | 22000 | 32000 | 47000 | 72000 | 112000 |
| Amount of deposited toner | | | | | | | |
| 0.5 to 0.55 | AAA | AA | XXX | XXX | XXX | XXX | XX |
| 0.35 to 0.4 | AAA | AAA | XXXX | XXX | XXX | XXX | XX |
| 0.25 to 0.3 | AAA | AAA | XXXA | XXXX | XXX | XXX | XX |
| 0.2 to 0.25 | AAA | AAA | AAA | XXX | XX | XXXA | XX |
| 0.15 to 0.2 | AAA | AAA | AAA | AA | XAX | XAXA | XX |
| 0.05 to 0.1 | AAA | AAA | AAA | AAA | AAAA | AAXA | XXAA |
| 0.05 or less | AAA | AAA | AA | AAA | AAA | AAA | AA |

TABLE 4

| Present invention | | | | | | | |
|---|---|---|---|---|---|---|---|
| Total count of printing | 0 | 12000 | 22000 | 32000 | 47000 | 72000 | 112000 |
| Amount of deposited toner | | | | | | | |
| 0.5 to 0.55 | AAA | AAA | AAA | AAA | AAA | AAA | AAA |
| 0.35 to 0.4 | AAA | AAA | AAA | AAA | AAA | AAA | AAA |
| 0.25 to 0.3 | AAA | AAA | AAA | AAA | AAA | AAA | AAA |
| 0.2 to 0.25 | AAA | AAA | AAA | AAA | AAA | AAA | AAA |
| 0.15 to 0.2 | AAA | AAA | AAAA | AA | AAAA | AAA | AAA |
| 0.05 to 0.1 | AAA | AAA | AAAA | AAA | AAAA | AAA | AAA |
| 0.05 or less | AAA | AAA | AA | AAA | AA | AAA | AA |

The above Tables have made it clear that, in an image formation using the toner having a mean circularity of 0.96 or more, continued stable cleaning performances are provided by the cleaning system equipped with a cleaning roller according to the present invention, wherein bias voltage is applied said cleaning roller used in combination with a cleaning blade and located on the upstream side.

The invention according to Embodiment 7 provides a cleaning system ensuring a continued sufficient cleaning of an image bearing member despite the use of toner of higher mean circularity, an image forming system equipped with said cleaning device and image forming method.

What is claimed is:

1. A cleaning apparatus, comprising: a cleaning roller being either conductive or semi-conductive and in contact with an image bearing member carrying charged toner;

a constant current source to apply a bias voltage, having a polarity opposite to that of toner utilized for a developing operation performed on said image bearing member, onto said cleaning roller;

a cleaning blade contacting said image bearing member and located at a downstream side of said cleaning roller in a moving direction of said image bearing member; and a control section to control said constant current source so as to increase an absolute value of an electric current applied by said constant current source according to an increase of an image-forming amount.

2. The cleaning apparatus of claim 1, wherein said cleaning roller rotates in such a manner that its contact surface moves in the same direction as said moving direction of said image bearing member at a position in contact with said image bearing member, and the ratio between a moving velocity of said cleaning roller and a moving velocity of said image bearing member at said contact surface is within a range of 0.5:1 to 2:1.

3. The cleaning apparatus of claim 1, further comprising:

a removing member for removing toner from said cleaning roller by contacting said cleaning roller.

4. The cleaning apparatus of claim 1, wherein said cleaning blade contacts said image bearing member with a pressing load being within a range of 1 to 30 grams/cm.

5. The cleaning apparatus of claim 1, wherein the contact angle between said image bearing member and said cleaning blade is within a range of 0 to 40 deg.

6. The cleaning apparatus of claim 1, wherein the hardness of said cleaning blade is within a range of 20 to 90 deg.

7. The cleaning apparatus of claim 1, wherein said image-forming amount is a number of sheets on which images are formed.

8. The cleaning apparatus of claim 1, wherein said control section controls said constant current source so as to increase an absolute value of a toner-collecting voltage applied by said constant current source according to an increase of an image-forming amount; and wherein said toner-collecting voltage is equivalent to said bias voltage.

9. The cleaning apparatus of claim 8, wherein said image-forming amount is a number of sheets on which images are formed.

10. The cleaning apparatus of claim 8, wherein said cleaning roller rotates in such a manner that its contact surface moves in the same direction as said moving direction of said image bearing member at a position in contact with said image bearing member, and the ratio between a moving velocity of said cleaning roller and a moving velocity of said image bearing member at said contact surface is within a range of 0.5:1 to 2:1.

11. The cleaning apparatus of claim 8, further comprising:

a removing member for removing toner from said cleaning roller by contacting said cleaning roller.

12. The cleaning apparatus of claim 1, wherein said control section controls said constant current source so as to apply either a toner-collecting voltage or a toner-releasing voltage onto said cleaning roller by selecting one of them in a time-sharing manner; and wherein both said toner-collecting voltage and said toner releasing voltage are equivalent to said bias voltage.

13. The cleaning apparatus of claim 12, wherein said toner-releasing voltage is applied at every completion of forming images on a predetermined number of sheets.

14. The cleaning apparatus of claim 13, wherein said predetermined number of sheets changes corresponding to a total number of sheets on which images are formed.

15. The cleaning apparatus of claim 14, wherein said toner-releasing voltage is generated by superimposing an alternative current voltage on a direct current voltage.

16. The cleaning apparatus of claim 1, wherein an average circularity of toner particles included in said toner is within a range of 0.96 to 0.99, and a toner deposit amount per unit area on a surface of said image bearing member is not greater than 0.25 mg/cm$^2$ at a surface area ranging from a first position at which said image bearing member contacts said cleaning roller to a second position at which said image bearing member contacts said cleaning blade.

17. The cleaning apparatus of claim 1, wherein an average circularity of toner particles included in said toner is not smaller than 0.96.

18. The cleaning apparatus of claim 17, wherein said cleaning roller is an elastic roller.

19. A cleaning apparatus comprising:

a cleaning roller being either conductive or semi-conductive and in contact with an image bearing member carrying a charged toner;

a constant current source to apply a bias voltage, having a polarity opposite to that of toner utilized for a developing operation performed on said image bearing member, onto said cleaning roller;

a cleaning blade contacting said image bearing member and located at a downstream side of said cleaning roller in a moving direction of said image bearing member; and a control section to control said constant current source so as to increase an absolute value of a toner-collecting voltage according to an increase of an image-forming amount, and so as to apply either said toner-collecting voltage or a toner-releasing voltage onto said cleaning roller by selecting one of them in a time-sharing manner, wherein both said toner-collecting voltage and said toner-releasing voltage are equivalent to said bias voltage.

20. The cleaning apparatus of claim 19, wherein said image-forming amount is a number of sheets on which images are formed.

21. The cleaning apparatus of claim 19, wherein said toner-releasing voltage is applied at every completion of forming images on a predetermined number of sheets.

22. The cleaning apparatus of claim 21, wherein said predetermined number of sheets changes corresponding to a total number of sheets on which images are formed.

23. The cleaning apparatus of claim 21, wherein said toner-releasing voltage is generated by superimposing an alternative current voltage on a direct current voltage.

24. An image-forming apparatus, comprising:

an image bearing member;

a developing device; and a cleaning apparatus, wherein said cleaning apparatus comprises:

a cleaning roller being either conductive or semi-conductive and in contact with said image bearing member carrying charged toner;

a constant current source to apply a bias voltage, having a polarity opposite to that of toner utilized for a developing operation performed on said image bearing member, onto said cleaning roller;

a cleaning blade contacting said image bearing member and located at a downstream side of said cleaning roller in a moving direction of said image bearing member; and a control section to control said constant current source so as to increase an absolute value of a toner-collecting voltage according to an increase of an image-forming amount, wherein said toner-collecting voltage is equivalent to said bias voltage.

25. The image-forming apparatus of claim 24, wherein said image bearing member is an organic photoreceptor.

26. The image-forming apparatus of claim 24, wherein said developing device performs a developing operation by employing toner particles formed by a polymerization method, in which a volume average particle size of said toner particles is within a range of 3.0 to 8.5 microns.

27. The image-forming apparatus of claim 24, wherein said control section controls said constant current source so as to apply either said toner-collecting voltage or a toner-releasing voltage onto said cleaning roller by selecting one of them in a time-sharing manner; and wherein said toner-releasing voltage is equivalent to said bias voltage.

28. The image-forming apparatus of claim 24, wherein said constant current source starts applying said bias voltage onto said cleaning roller after said image bearing member started moving and after a developing bias voltage has been applied onto said developing device, and further, said constant current source stops applying said bias voltage onto said cleaning roller before said image bearing member stops moving and before an operation of applying said developing bias voltage onto said developing device is finished.

29. The image-forming apparatus of claim 24, wherein dimension W1 (mm), which indicates a width of said cleaning roller in its longitudinal direction, dimension W2 (mm), which indicates a width of a developer feeding device employed for said developing device in its longitudinal direction, and dimension W3 (mm), which indicates a width of the photosensitive layer on said image bearing member, fulfill a relational expression of $$W2<W1<W3.$$

30. The image-forming apparatus of claim 24, wherein said constant current source applies said bias voltage onto said cleaning roller so that a toner deposit amount per unit area on a surface of said image bearing member is not greater than 0.25 $mg/cm^2$ at a surface area at which said image bearing member contacts said cleaning roller.

31. The image-forming apparatus of claim 30, wherein a fur brushing roller is employed for said cleaning roller.

32. The image-forming apparatus of claim 24, wherein an average circularity of toner particles included in said toner is within a range of 0.96 to 0.99, and a mass average particle size of said toner particles is within a range of 3 to 10 microns.

33. An image forming apparatus, comprising:

a first image bearing member;

a plurality of developing devices arranged around a periphery of said first image bearing member;

a second image bearing member on which a toner image formed on said first image bearing member is temporarily transferred;

a cleaning apparatus equipped for either said first image bearing member or said second image bearing member;

wherein said cleaning apparatus comprises:

a cleaning roller being either conductive or semi-conductive and in contact with said first image bearing member or said second image bearing member carrying charged toner;

a constant current source to apply a bias voltage, having a polarity opposite to that of toner utilized for a developing operation performed on said first image bearing member or said second image bearing member, onto said cleaning roller;

a cleaning blade contacting said first image bearing member or said second image bearing member and located at a downstream side of said cleaning roller in a moving direction of said first image bearing member or said second image bearing member; and a control section to control said constant current source so as to increase an absolute value of a toner-collecting voltage according to an increase of an image-forming amount, wherein said toner-collecting voltage is equivalent to said bias voltage.

* * * * *